US006112366A

United States Patent [19]

Berfield

[11] Patent Number: 6,112,366

[45] Date of Patent: Sep. 5, 2000

[54] OUTLET PRIMING SELF-EVACUATION VACUUM CLEANER

[75] Inventor: Robert C. Berfield, Jersey Shore, Pa.

[73] Assignee: Shop Vac Corporation, Williamsport, Pa.

[21] Appl. No.: 09/234,557

[22] Filed: Jan. 20, 1999

[51] Int. Cl.[7] ..... A47L 7/00

[52] U.S. Cl. ..... 15/352; 15/353; 96/406

[58] Field of Search ..... 15/339, 321, 353, 15/352; 96/406

[56] References Cited

U.S. PATENT DOCUMENTS

| | | | |
|---|---|---|---|
| D. 344,822 | 3/1994 | Miller et al. . | |
| D. 354,380 | 1/1995 | Stephens . | |
| D. 355,109 | 2/1995 | Moine et al. . | |
| D. 357,336 | 4/1995 | Moine et al. . | |
| D. 357,773 | 4/1995 | Wareham et al. . | |
| D. 361,179 | 8/1995 | Moine et al. . | |
| D. 372,567 | 8/1996 | Moine et al. . | |
| D. 373,862 | 9/1996 | Stephens et al. . | |
| 961,816 | 6/1910 | Squier . | |
| 1,661,480 | 3/1928 | Keefer . | |
| 1,691,164 | 11/1928 | Monk | 15/321 |
| 1,840,257 | 1/1932 | Saxe et al. . | |
| 1,849,093 | 3/1932 | Janette . | |
| 1,982,345 | 11/1934 | Kirby . | |
| 1,993,267 | 3/1935 | Ferguson . | |
| 2,049,603 | 8/1936 | Dietenberger . | |
| 2,292,435 | 8/1942 | Crites | 15/321 |
| 2,424,657 | 7/1947 | Goodman . | |
| 2,470,066 | 5/1949 | Calabrese . | |
| 2,499,876 | 3/1950 | Platek . | |
| 2,643,732 | 6/1953 | Keen . | |
| 2,657,416 | 11/1953 | Smith . | |
| 2,718,656 | 9/1955 | Kirk . | |
| 2,757,406 | 8/1956 | Decker . | |
| 2,791,964 | 5/1957 | Reeve . | |
| 2,909,800 | 10/1959 | Grindle et al. . | |
| 2,932,844 | 4/1960 | O'Connor . | |
| 2,934,623 | 4/1960 | Christensen . | |
| 2,972,769 | 2/1961 | Keating et al. . | |
| 3,029,461 | 4/1962 | Osborn . | |
| 3,048,875 | 8/1962 | Bottinelli et al. . | |
| 3,173,164 | 3/1965 | Congdon | 15/314 |
| 3,303,785 | 2/1967 | Pearce . | |
| 3,327,144 | 6/1967 | Double . | |
| 3,345,488 | 10/1967 | Siegal . | |
| 3,355,762 | 12/1967 | Cavell et al. . | |
| 3,398,250 | 8/1968 | Bowers . | |
| 3,471,663 | 10/1969 | Farrell et al. . | |
| 3,496,592 | 2/1970 | Jones . | |
| 3,502,825 | 3/1970 | Bailey et al. . | |

(List continued on next page.)

FOREIGN PATENT DOCUMENTS

| | | |
|---|---|---|
| 0 012 337 | 6/1980 | European Pat. Off. . |
| 0 017 519 | 10/1980 | European Pat. Off. . |
| 2 484 558 | 12/1981 | France . |
| 40 17 366 | 12/1991 | Germany . |
| 2246284A | 1/1992 | United Kingdom . |

OTHER PUBLICATIONS

PCT International Search Report for International application No. PCT/US97/12067, filed Jul. 11, 1997 (4 pages).

PCT International Search Report for International application No. PCT/US97/18134, filed Oct. 6, 1997 (4 pages).

PCT International Search Report for International application No. PCT/US98/00597, filed Jan. 14, 1998 (4 pages).

*Primary Examiner*—Chris K. Moore

*Attorney, Agent, or Firm*—Marshall, O'Toole, Gerstein, Murray & Borun

[57] ABSTRACT

A vacuum cleaner has an electric motor driving an air impeller for creating suction and a pump which draws liquid material through an inlet tube from the bottom of a tank and expels it from the tank. A priming mechanism is disposed in fluid communication with the outlet portion of the pump. The priming mechanism primes the pump from the outlet side of the pump by collecting liquid received by the tank of the vacuum cleaner in the priming mechanism and establishing a pressure differential across this collected liquid.

21 Claims, 14 Drawing Sheets

U.S. PATENT DOCUMENTS 3,552,100 1/1971 Ekenberg .
3,605,786 9/1971 Machin, Jr. .
3,614,797 10/1971 Jones .
3,616,482 11/1971 Brycki .
3,720,977 3/1973 Brycki .
3,774,260 11/1973 Emus, Jr. .
3,818,537 6/1974 Evans .
3,828,390 8/1974 Cater .
3,909,197 9/1975 Cremers .
3,914,592 10/1975 Maxey .
3,939,527 2/1976 Jones .
3,942,217 3/1976 Bates .
3,977,797 8/1976 Paterson .
4,021,144 5/1977 Matsusaka .
4,080,104 3/1978 Brown, Jr. .
4,087,706 5/1978 Koester, Jr. .
4,087,881 5/1978 Bates .
4,114,229 9/1978 Jones et al. .
4,123,818 11/1978 Hurwitz .
4,138,761 2/1979 Nauta .
4,153,968 5/1979 Perkins .
4,171,208 10/1979 Lowder .
4,179,768 12/1979 Sawyer .
4,185,354 1/1980 Brazier .
4,194,262 3/1980 Finley et al. .
4,207,649 6/1980 Bates .
4,216,563 8/1980 Cyphert .
4,218,805 8/1980 Brazier .
4,226,000 10/1980 Tribolet .
4,244,079 1/1981 Bane .
4,246,676 1/1981 Hallsworth et al. .
4,267,617 5/1981 Brown et al. .
4,287,636 9/1981 Brazier .
4,314,385 2/1982 Wimsatt et al. .
4,318,202 3/1982 Holman .
4,321,219 3/1982 Barker .
4,329,756 5/1982 Chicoine et al. .
4,348,783 9/1982 Swanson et al. .
4,353,145 10/1982 Woodford .
4,397,057 8/1983 Harbeck .
4,458,377 7/1984 Frohbieter .
4,654,926 4/1987 McCambridge .
4,667,364 5/1987 Meili .
4,675,935 6/1987 Kasper et al. .
4,723,337 2/1988 Ellison et al. .
4,741,069 5/1988 Helm et al. .
4,776,058 10/1988 Garner et al. .
4,788,738 12/1988 Monson et al. .
4,800,612 1/1989 Valentine .
4,800,613 1/1989 Blase et al. .
4,801,376 1/1989 Kulitz .
4,809,396 3/1989 Houser .
4,827,562 5/1989 Blase et al. .
4,841,595 6/1989 Wiese .
4,845,793 7/1989 Meyer .
4,847,943 7/1989 Blase et al. .
4,864,680 9/1989 Blase et al. .
4,934,017 6/1990 Kent .
4,949,424 8/1990 Shero .
4,956,891 9/1990 Wulff .
4,974,282 12/1990 Stoltz et al. .
4,976,850 12/1990 Kulitz .
4,977,638 12/1990 Best .
5,012,549 5/1991 Williams et al. .
5,048,148 9/1991 Gleadall .
5,086,537 2/1992 McDowell et al. .
5,099,543 3/1992 Wade .
5,120,922 6/1992 Brouillette .
5,125,126 6/1992 Bonnant .
5,134,748 8/1992 Lynn .
5,174,730 12/1992 Nieuwkamp et al. .
5,182,834 2/1993 Wright et al. .
5,184,370 2/1993 Jung .
5,189,755 3/1993 Yonkers et al. .
5,210,902 5/1993 Lee et al. .
5,244,003 9/1993 Boomgaarden .
5,263,225 11/1993 Winters .
5,267,370 12/1993 Worwag .
5,287,587 2/1994 Yonkers et al. ..... 15/320
5,287,590 2/1994 Yonkers et al. ..... 15/321
5,289,611 3/1994 Yonkers et al. .
5,330,699 7/1994 Shetler et al. .
5,334,000 8/1994 Nordlin .
5,349,722 9/1994 Chayer .
5,373,606 12/1994 Bosyj et al. .
5,388,301 2/1995 Bosyj et al. .
5,404,614 4/1995 Stephens .
5,406,673 4/1995 Bradd et al. .
5,430,910 7/1995 Wiley .
5,443,362 8/1995 Crites et al. .
5,455,983 10/1995 Crouser et al. .
5,455,984 10/1995 Blase .
5,465,455 11/1995 Allen .
5,469,598 11/1995 Sales .
5,526,547 6/1996 Williams et al. .
5,535,500 7/1996 Stephens et al. .
5,555,597 9/1996 Berfield .
5,715,568 2/1998 Berfield et al. .
5,918,344 7/1999 Creveling et al. ..... 15/353 X
5,920,955 7/1999 Berfield ..... 15/353 X
5,966,775 10/1999 Berfield ..... 15/353

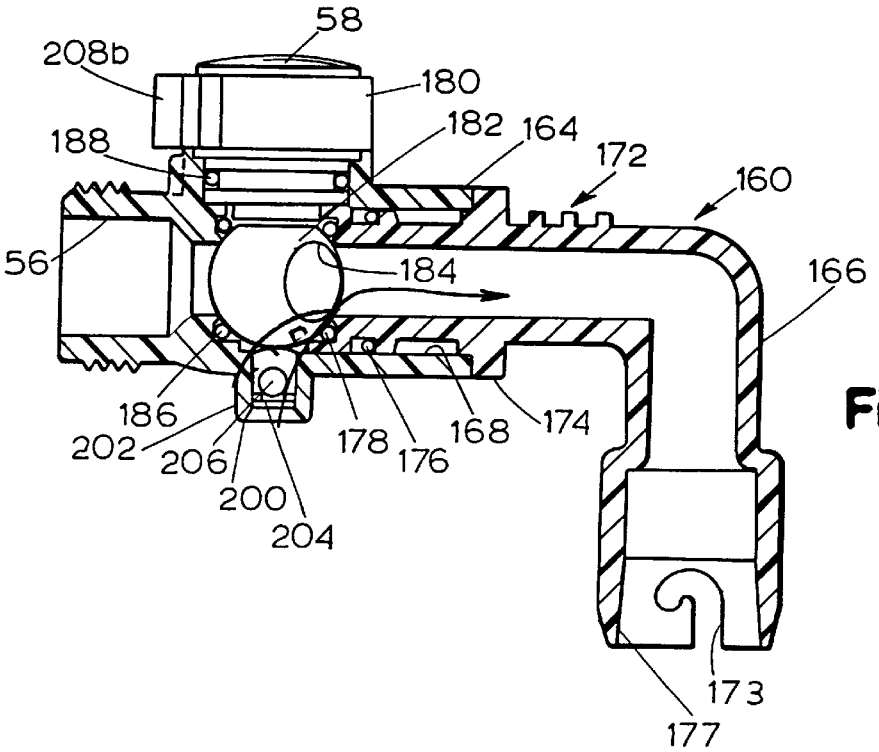
Fig. 7
Fig. 8
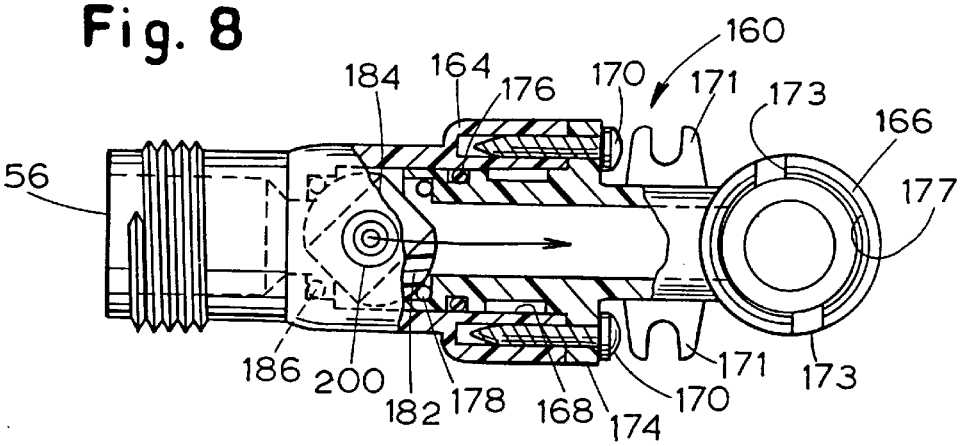
Fig. 9A
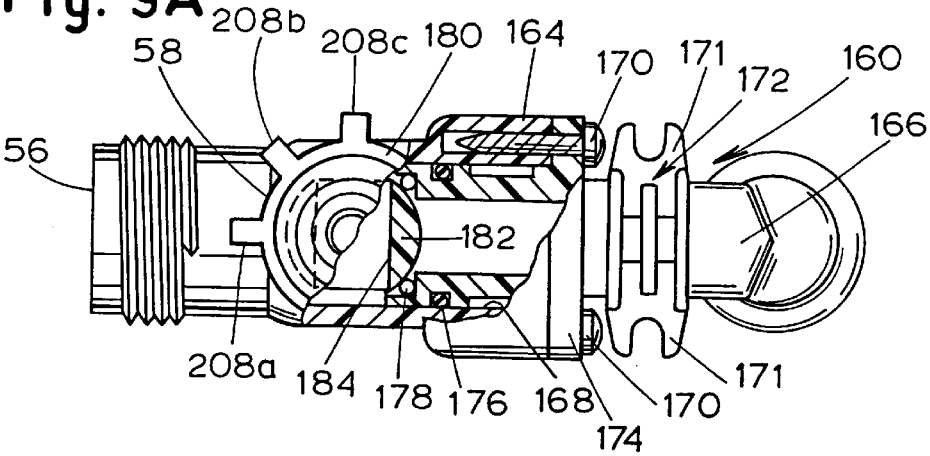

Fig. 17A
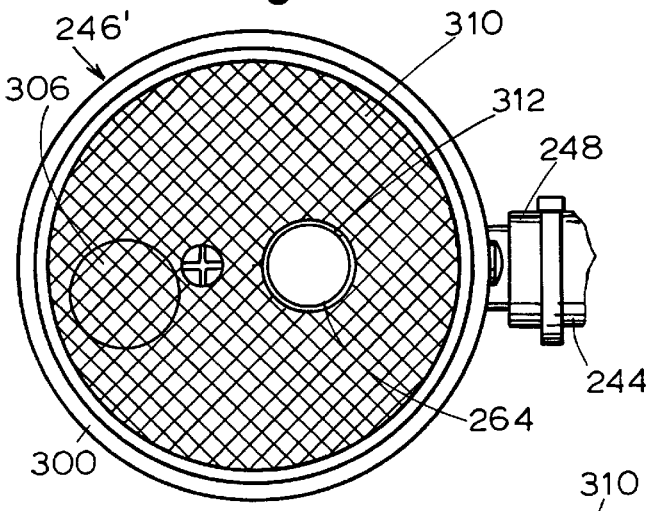
Fig. 17B
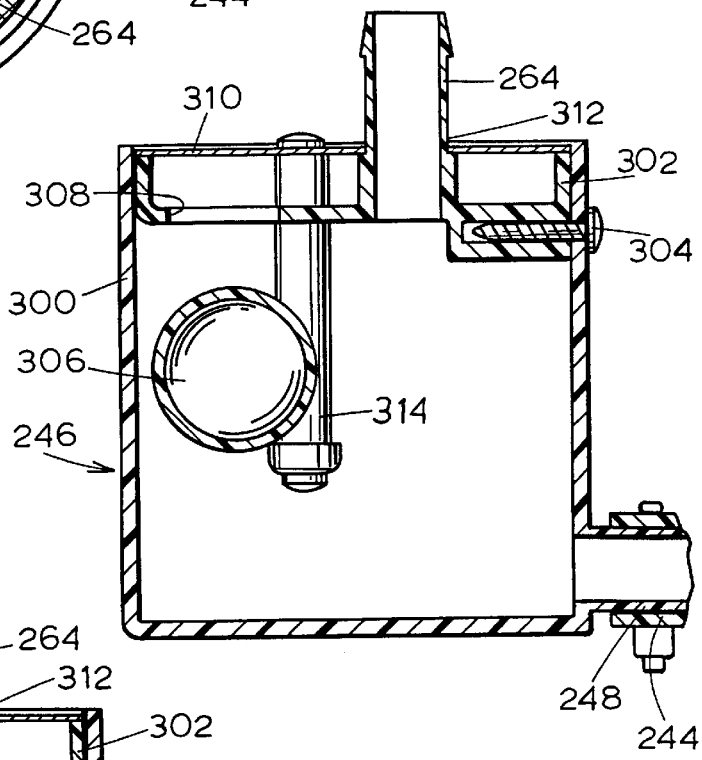
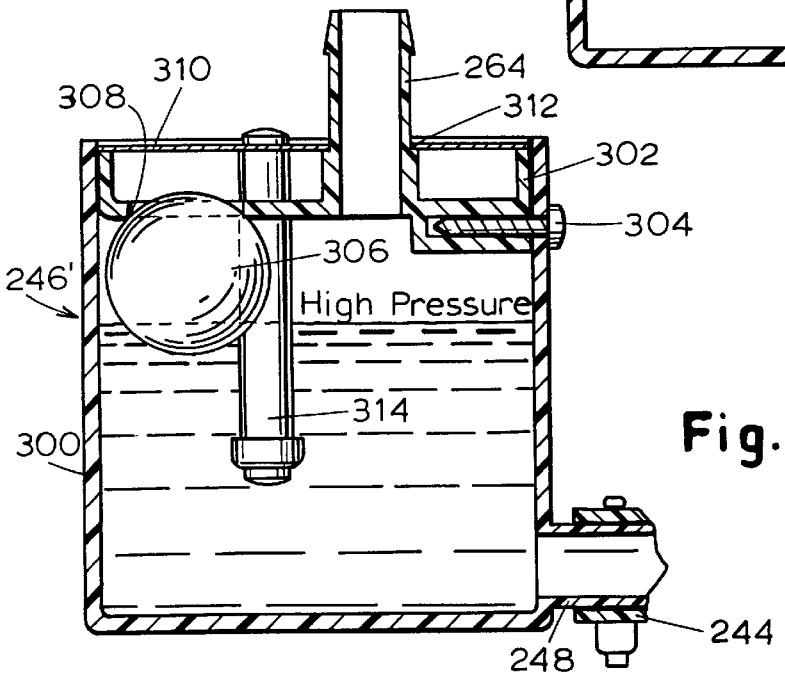
Fig. 18

OUTLET PRIMING SELF-EVACUATION VACUUM CLEANER

FIELD OF THE INVENTION

The present invention relates to vacuum cleaners, and more particularly to wet/dry vacuum cleaners where liquid material in the tank of the vacuum cleaner is pumped out to waste.

BACKGROUND ART

Tank-type vacuum cleaners are capable of receiving dry materials such as debris or dirt and may also be used for suctioning liquids. When the tank is full, an upper vacuum assembly (which often includes a motor and an air impeller) is removed and the contents are dumped out. If the vacuum cleaner is used on liquid material, the tank, when at or near capacity, may be very heavy so that lifting the tank, to pour the contents into a sink or the like, is difficult. Even tilting the tank to pour the contents into a floor drain may be unwieldy when the liquid level in the tank is high.

One solution to the difficulties encountered in emptying liquid from vacuum tanks has been to provide an outlet at the bottom of the tank. Such a solution is satisfactory when the contents of the tank are emptied into a floor drain; however, if no floor or other low-placed drain is available the tank must be lifted to a sink or similar disposal site. In such cases the outlet at the bottom of the tank is of little value.

A second solution to emptying a vacuum tank of liquid is to provide a pump, usually with a motor located outside of or in the bottom of the tank. The pump removes liquid through a lower portion of the tank and expels it through a hose to waste. While such pumps are generally effective, they may be very costly. The pump requires not only a pump impeller and hoses but also its own electric motor, power cords, and switches. The expense of such items may be significant in the context of the overall cost of a vacuum cleaner, particularly those designed for residential use. Such pumps may also reduce the effective capacity of the vacuum tank or interfere with operation when the vacuum cleaner is used on dry materials. In addition, it may also be necessary to provide costly or complicated structures to prime the pump, if the pump is not located in the bottom of the tank.

SUMMARY OF THE INVENTION

Other features and advantages are inherent in the vacuum cleaner claimed and disclosed or will become apparent to those skilled in the art from the following detailed description in conjunction with the accompanying drawings.

BRIEF DESCRIPTION OF THE DRAWINGS

FIG. 7 is a partial view, partially in section, showing an upper portion of a liquid discharge assembly of the present invention;

FIG. 8 is a bottom view, partially broken away and partially in phantom of a ball valve in the position of FIG. 7;

FIG. 9A is a partially broken away top view of the ball valve of FIG. 8 with the ball valve in a closed (OFF) position;

FIG. 17A is a top view of a priming mechanism of the second embodiment of the present invention;

FIG. 17B is a sectional view of the priming mechanism of the second embodiment of the present invention; and FIG. 18 is a sectional view similar to FIG. 17B showing the priming mechanism partially filled with liquid.

DETAILED DESCRIPTION OF THE EMBODIMENTS

Figure 1:
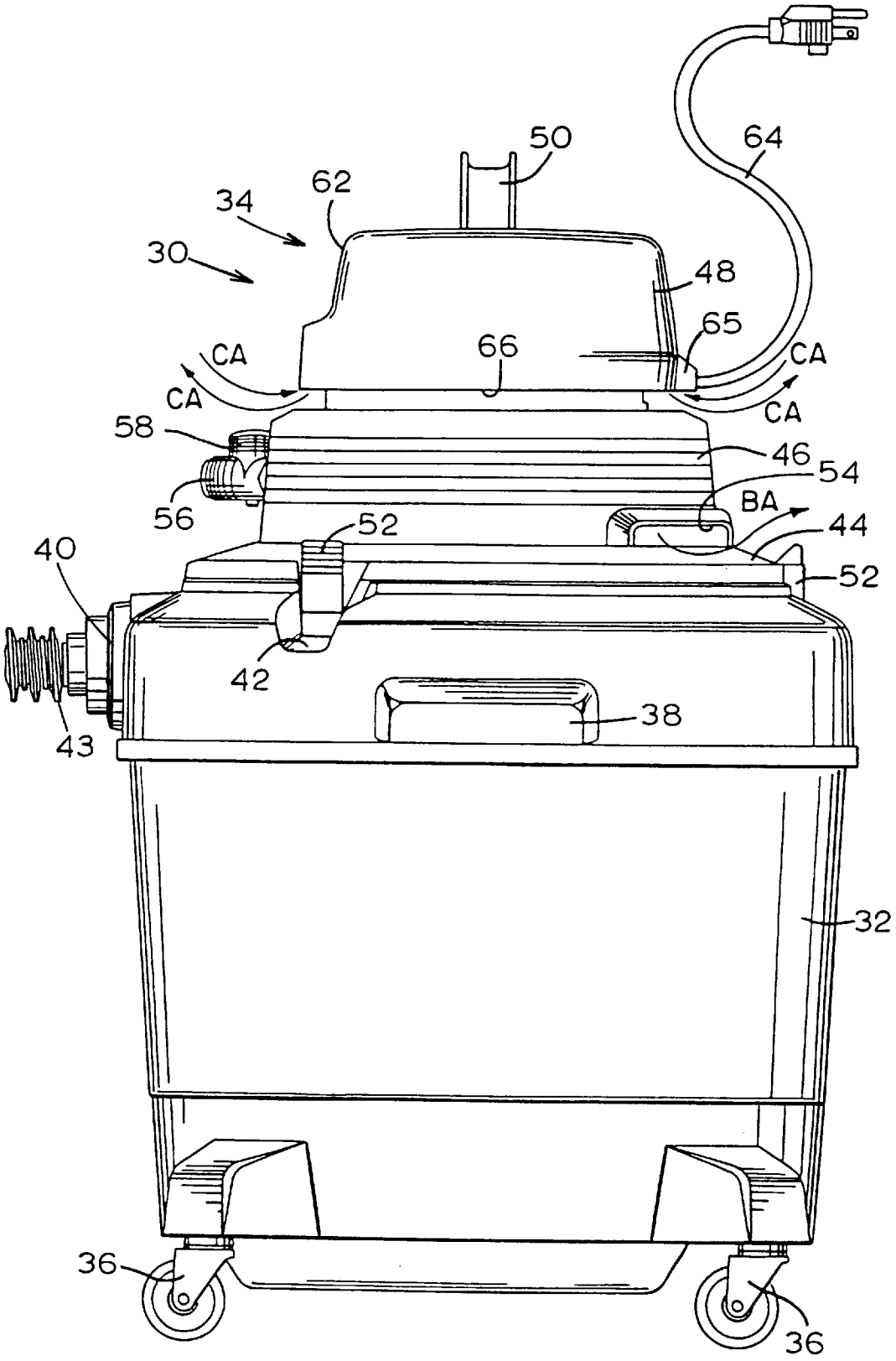
FIG. 1 is a side elevational view of a vacuum cleaner of the present invention.
Figure 2:
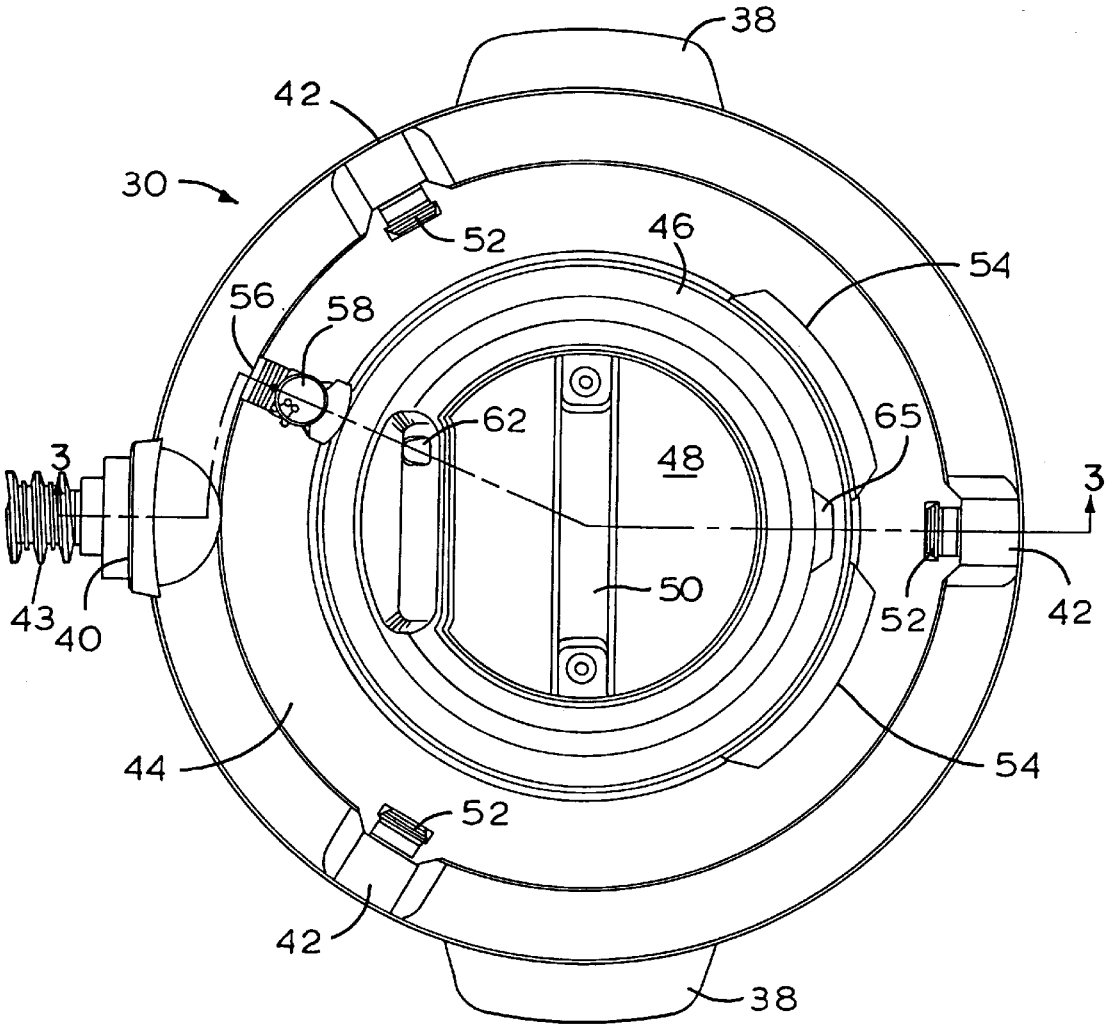
FIG. 2 is a top plan view of a vacuum cleaner of the present invention.

Referring initially to FIGS. 1 and 2, a vacuum cleaner of the present invention, indicated generally at 30, has a tank 32 and an upper vacuum assembly, indicated generally at 34.

The tank 32 is supported by casters 36 and includes a pair of handles 38. The handles 38 may be used to assist the user in lifting and moving the vacuum cleaner 30. The tank 32 further defines a vacuum inlet 40 and a number of latch recesses 42. The vacuum inlet 40 may be fitted with a vacuum hose 43 for applying suction at desired locations.

The tank 32 supports the upper vacuum assembly 34. The upper vacuum assembly 34 includes a lid 44, a motor housing 46, a cover 48 and a handle 50. The upper vacuum assembly 34 may be of conventional construction. Except as described below, the upper vacuum assembly 34 and its associated components may be similar to a Shop Vac Model QL20TS vacuum cleaner as manufactured by Shop Vac Corporation of Williamsport, Pa. The lid 44 makes up the bottom of the upper vacuum assembly 34 and carries one or more latches 52. The motor housing 46 is connected to the top of the lid 44. The cover 48, in turn, is connected to the top of the motor housing 46, and finally, the handle 50 sits atop the cover 48. When a user wishes to connect the upper vacuum assembly 34 to the tank 32, the user lifts the upper vacuum assembly 34 above the tank 32, aligns the latches 52 with the latch recesses 42, lowers the upper vacuum assembly 34 until the lid 44 rests on top of the tank 32, and then, fastens the latches 52 to the tank 32.

The motor housing 46 defines a pair of blower air discharge slots 54. Air drawn into the vacuum cleaner 30 by the inlet 40 is expelled through the blower air discharge slots 54 as shown by the arrow BA in FIG. 1. The motor housing 46 also has a vacuum cleaner discharge opening 56 and a three position ball valve 58 extending therefrom. The cover 48 of the upper vacuum assembly 34 provides a housing for a switch actuation assembly 60 (FIG. 3) which includes a user engageable actuator 62 (FIG. 2). Extending outward from the cover 48 is an electric cord 64 (FIG. 1) which passes through a relief 65 formed in the cover 48. The motor housing 46 and the cover 48 may be formed as two separate, detachable pieces or as one piece, integral with one another. With either construction, the motor housing 46 and the cover 48 define an air passage 66 which allows air to enter and exit the cover 48, as shown by the arrows CA in FIG. 1.

Figure 6:
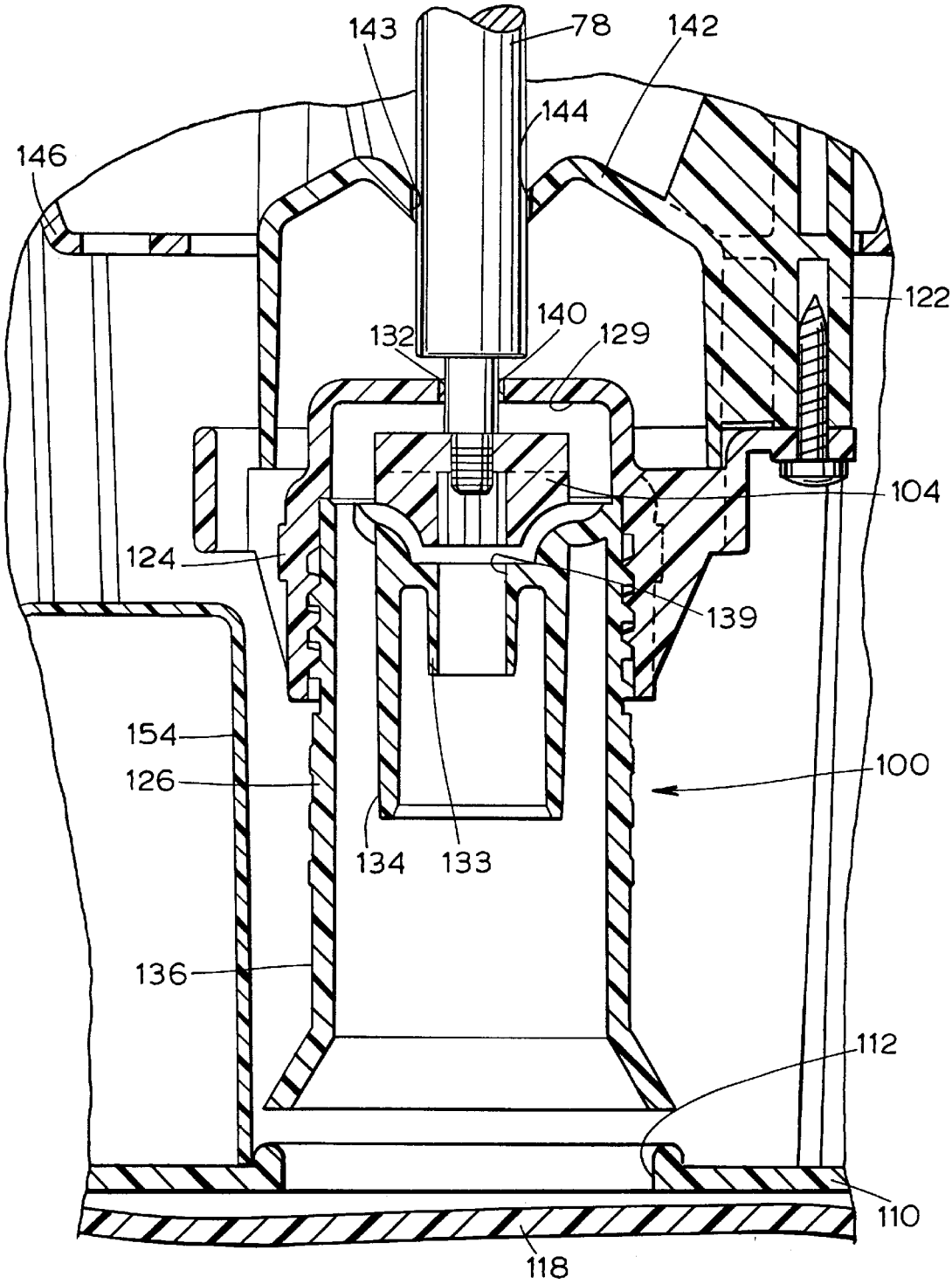
FIG. 6 is an enlarged view of a pump housing of FIG. 3.

Referring now to FIGS. 3–6, disposed in the upper vacuum assembly 34, among other things, is an air impeller assembly 68. As detailed in FIGS. 4 and 5, the air impeller assembly 68 includes an air impeller 74 disposed in a housing 70. (If desired, the vacuum cleaner 30 may have multiple air impellers.) The air impeller 74 is suspended within the housing 70 by the interaction of a series of washers and a motor shaft connection. The air impeller 74 includes an upper plate 84 and a lower plate 86 with a series of blades 88 disposed between the two plates 84,86. A motor shaft 76 extends from a motor 93 (FIG. 3—depicting a lower portion of the motor 93), passes through a flanged washer 80, a flat washer 82A, an opening 90 formed in upper plate 84 of the air impeller 74 and a flat washer 82B and threads into a shaft extension 78, securing the shaft extension 78 to the motor shaft 76. The flanged washer 80 and the flat washer 82A are disposed between the upper plate 84 and a motor bearing 102 (FIG. 3), and the flat washer 82B is disposed between the upper plate 84 and the shaft extension 78. The washers act to stabilize the air impeller during operation. The shaft extension 78, secured to the motor shaft 76, extends from the flat washer 82B through an opening 92 formed in the lower plate 86 of the air impeller 74, through an opening 72 formed in the air impeller housing 70, and, eventually, threads into a pump impeller 104 (FIG. 6). As such, the motor 93 acts to suspend the air impeller 74 and the pump impeller 104, at their respective locations, within the vacuum cleaner 30. More importantly, though, this configuration allows the motor 93, via the motor shaft 76 and the shaft extension 78, to simultaneously drive both the air impeller 74 and the pump impeller 104. As an alternative, the shaft extension 78 may be formed integral with the motor shaft 76 so that a unitary structure drives the air impeller 74 and the pump impeller 104. Another alternative is for the shaft extension 78 to be offset from the motor shaft 76, and torque would then be transferred from the motor shaft 76 to the shaft extension 78 via a transmission or a gear train. The impeller drive alternatives recited herein are by way of illustration only, and the air and pump impellers 74,104 discussed herein may be driven by any method known to those of ordinary skill in the art.

Figure 3:
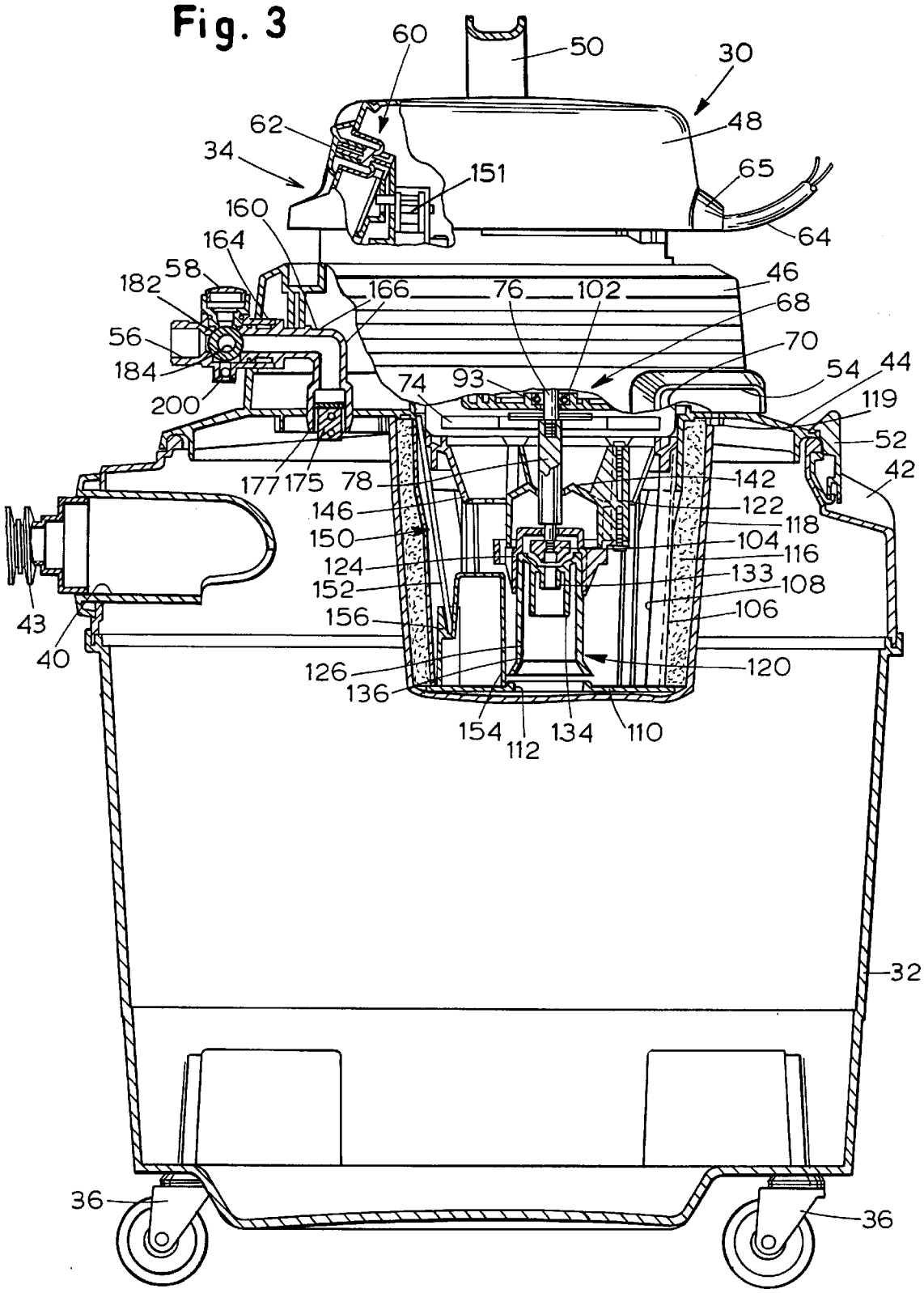
FIG. 3 is a side elevational view, partially in section along the line 3—3 in FIG. 2.
Figure 4:
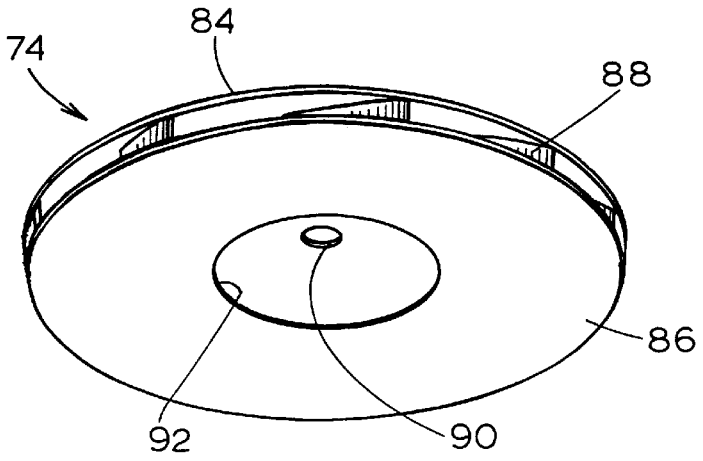
FIG. 4 is a perspective view of an air impeller of the present invention.
Figure 5:
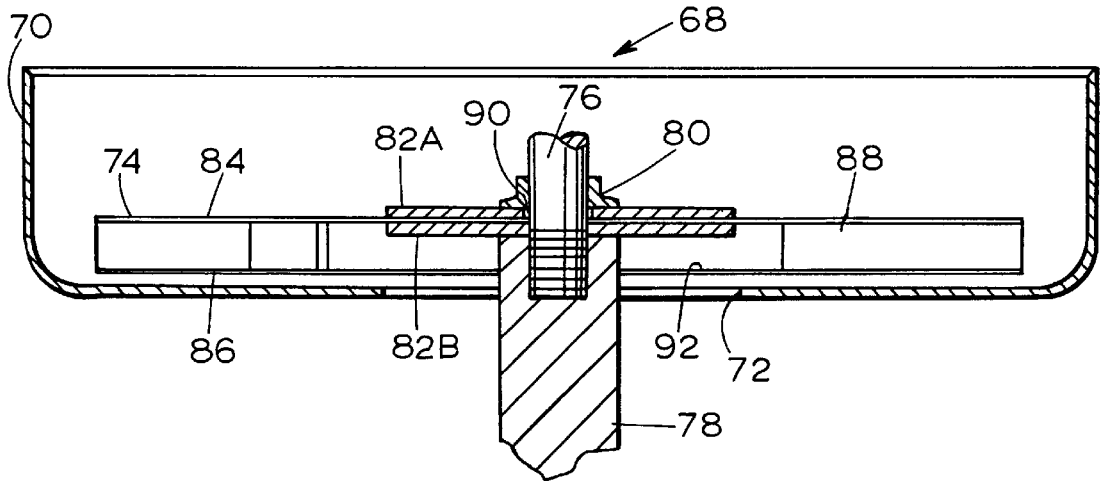
FIG. 5 is a partial view, partially in section, showing an air impeller assembly of the present invention.

As seen in FIG. 3, the upper vacuum assembly 34 also includes a lid cage 106 which, in this embodiment, is integrally formed with the lid 44 and extends downward therefrom. The air impeller assembly 68 is disposed within the lid cage 106, and the air impeller 74 draws air through the lid cage 106. The lid cage 106 includes several braces 108 that support a bottom plate 110. The bottom plate 110 defines an oblong opening 112. A removable foam filter 116 surrounds the circumference of the lid cage 106 and, as depicted in FIG. 3, a cloth filter 118 may be placed around the lid cage 106 during dry use of the vacuum cleaner 30 to keep dust from entering the opening 112 and interfering with the lid cage assemblies. A mounting ring 119 holds the foam and cloth filters 116, 118 in place. The mounting ring 119 is put in place by sliding the ring 119 over the foam and cloth filters 116, 118 and sliding the ring 119 up to the bottom of the lid 44. Instead of using a separate foam and cloth filter 116,118, as described above, a unitary cartridge filter may be used which allows for easier replaceability.

Figure 11:
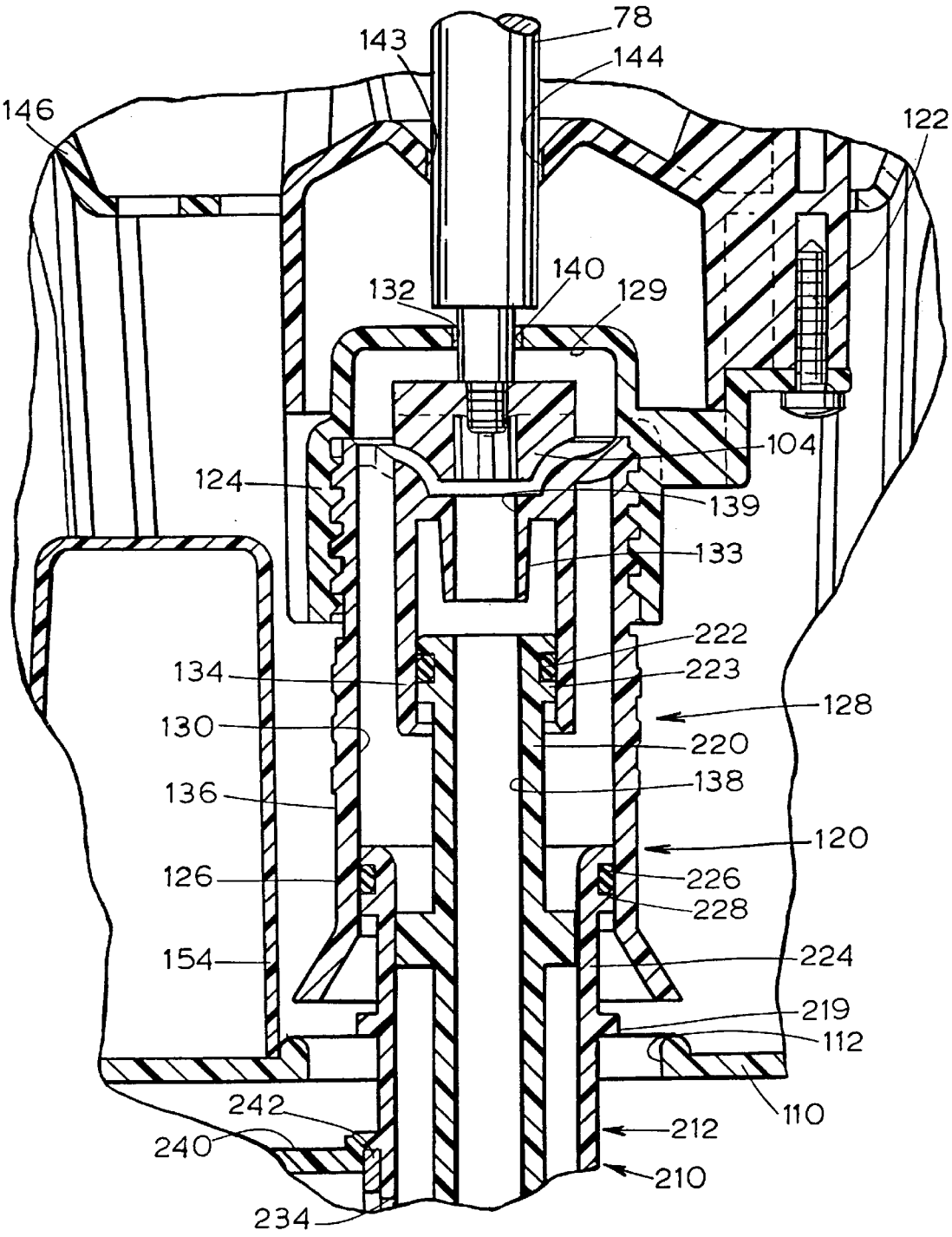
FIG. 11 is an enlarged view of a pump of FIG. 10.

Included within the lid cage 106 is an upper pump assembly indicated generally at 120 which, as described below, forms the upper portion of a pump 128 (FIG. 11). The upper pump assembly 120 attaches to a pump mount 122 which connects the upper pump assembly 120 to the air impeller housing 70. As detailed in FIG. 6, the upper pump assembly 120 includes an upper impeller housing 124 which is connected to the pump mount 122; a lower impeller housing 126 which, in this embodiment, is threaded into the upper impeller housing 124; and the pump impeller 104 which, as described above, is connected to the shaft extension 78. The interior of the upper impeller housing 124 and the top of the lower impeller housing 126 form a pump chamber 129. The shaft extension 78 keeps the pump impeller 104 suspended in the pump chamber 129 between the upper and lower impeller housings 124, 126 allowing the pump impeller 104 to rotate freely therein. The pump impeller 104 is preferably made of nylon 6, and the upper and lower impeller housings 124, 126 are preferably made from acrylonitrile-butadiene styrene copolymer ("ABS"). The upper impeller housing 124 defines an opening 132 through which the shaft extension 78 passes to connect with the pump impeller 104. The diameter of the shaft extension 78 and the diameter of the opening 132 are sized such that an annular gap 140 having a diametral clearance on the order of 0.030 inches is created between them. The clearance in the gap 140 may fluctuate +/−0.015 inches due to the tolerances allowed in the manufacture of the shaft extension 78 and the opening 132. The gap 140 is intentionally unsealed to allow fluid communication between the tank 32 and the pump chamber 129. Also, since the gap 140 is unsealed, the shaft extension 78 does not rub against any other components when the shaft extension 78 is rotating and, as such, does not need to be cooled when the vacuum cleaner 30 is in operation.

The lower impeller housing 126 defines a series of annular sidewalls: an upper outlet sidewall 136, an inlet sidewall 134 and a impeller protection sidewall 133. The upper outlet sidewall 136 is the outermost and longest sidewall of the lower impeller housing 126, and when the pump 128 is assembled, the upper outlet sidewall 136 forms part of a pump outlet 130 (FIG. 11). The bottom portion of the upper outlet sidewall 136 is flared outward to ease assembly of the pump 128. The inlet sidewall 134 is disposed between the upper outlet sidewall 136 and the impeller protection sidewall 133 and is of intermediate length. The inlet sidewall 134 forms part of a pump inlet 138 (FIG. 11) when the pump 128 is assembled. The impeller protection sidewall 133 is the innermost and shortest sidewall of the lower impeller housing 126 and forms an opening 139 which allows fluid communication between the pump inlet 138 (FIG. 11) and the pump chamber 129 when the pump 128 is assembled. The impeller protection sidewall 133 serves to keep objects larger than the diameter of the impeller protection sidewall 133 (e.g. a user's finger) away from the pump impeller 104 when the pump impeller 104 is in operation. As an alternative to using an impeller protection sidewall 133, a screen or other restrictive device may be disposed across the interior of the inlet sidewall 134 to perform the same function of preventing foreign objects from passing through the opening 139 and interfering with the pump impeller 104.

A liquid deflector 142, formed integrally with the pump mount 122, is situated above the upper impeller housing 124 between the air impeller housing 70 (FIG. 3) and the upper impeller housing 124. The liquid deflector 142 acts to deflect any liquid that passes through the upper impeller housing gap 140 when the pump 128 is operating. Such liquid deflection keeps liquid from entering the air impeller assembly 68 and interfering with the operation of the air impeller 74. Similar to the upper impeller housing 124, the liquid deflector 142 also defines an opening 143 through which the shaft extension 78 passes. As with the opening 132 of the upper impeller housing 124, an annular gap 144 is formed in the opening 143 between the shaft extension 78 and the liquid deflector 142. The gap 144, similar to the gap 140, allows air flow communication between the tank 32 and the pump chamber 129.

Referring again to FIG. 3, the lid cage 106 also encloses an air impeller protection cage 146. The air impeller protection cage 146 extends downward from the bottom of the air impeller housing 70 and is disposed around the pump mount 122. The protection cage 146 acts to keep large debris out of the air impeller assembly 68 to prevent such debris from interfering with the operation of the air impeller 74. The protection cage 146 is formed of ribbed slats which allow the protection cage 146 to keep large debris out of the air impeller assembly 68 while allowing air to flow between the air impeller assembly 68 and the tank 32.

The upper vacuum assembly 34 also houses a mechanical shut-off and override assembly indicated generally at 150. The mechanical shut-off and override assembly 150 includes the aforementioned switch actuation assembly 60, a switch 151, a float rod 152 and a float 154. The mechanical shut-off and override assembly 150 may be of any conventional design or may be of the type disclosed and claimed in U.S. patent application Ser. No. 08/727,318, now U.S. Pat. No. 5,918,344, issued Jul. 6, 1999, In this embodiment, the switch actuation assembly 60 and the switch 151 are located in the cover 48, and the float 154 rests on the bottom plate 110 of the lid cage 106. The switch 151 controls the power to the motor 93 and has an "ON" and "OFF" position. The switch 151 is linked to the user engageable actuator 62 and to the float 154. The float 154 is hollow and may be made of any suitable material, such as copolymer polypropylene. The float 154 defines a rod receptacle 156 in which the float rod 152 sits. The float rod 152 extends upward from the float 154 and passes through the lid 44 and the motor housing 46, providing the linkage between the switch 151 and the float 154.

Figure 9B:
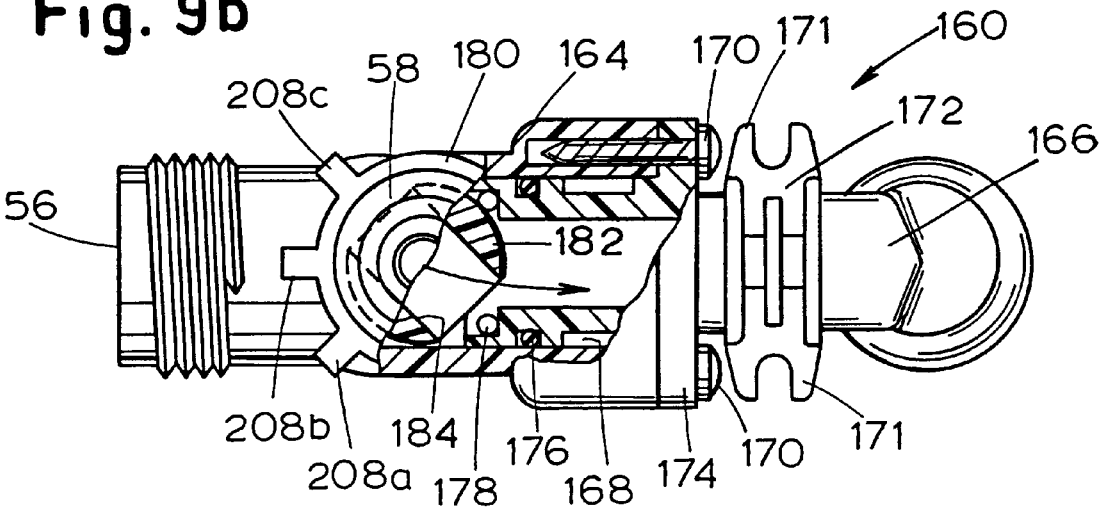
FIG. 9B is a top view similar to that of FIG. 9A with the ball valve in a priming position.
Figure 9C:
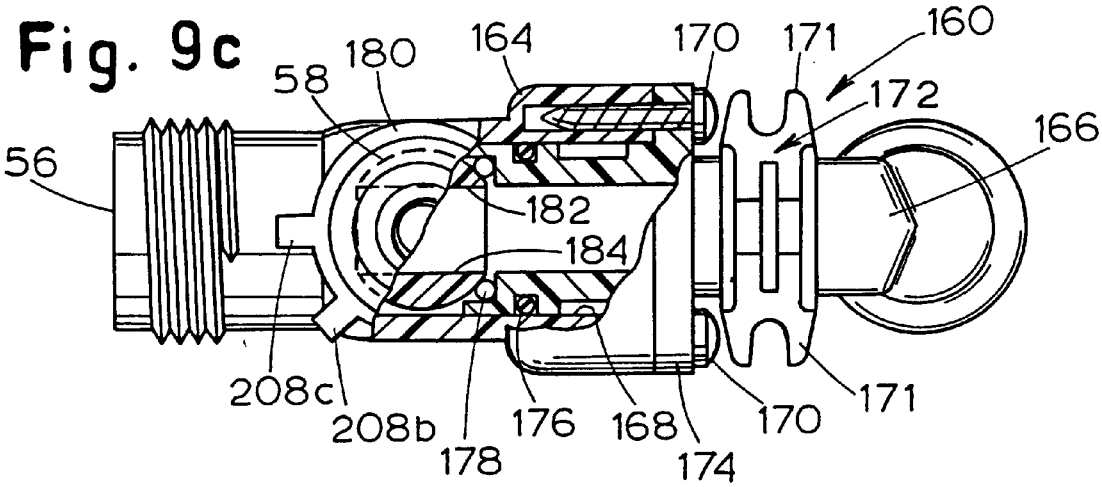
FIG. 9C is a top view similar to FIGS. 9A and B showing the ball valve in a full open (ON) position.
Figure 10:
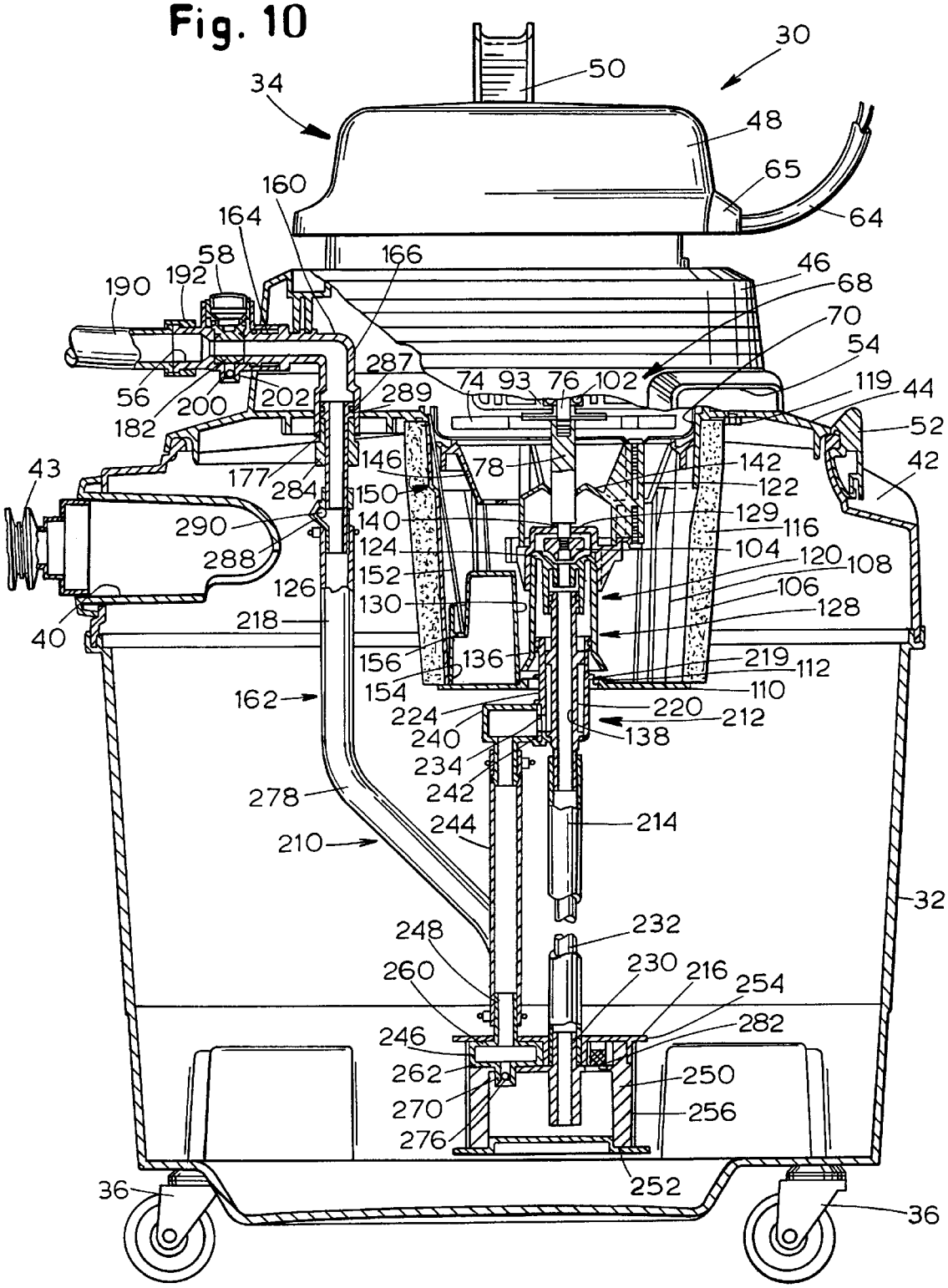
FIG. 10 is a view similar to FIG. 3 with a pump adapter assembly installed and a discharge hose attached to the vacuum cleaner of the present invention.

Also housed in the upper vacuum assembly 34 is an upper portion 160 of a liquid discharge assembly 162 (FIG. 10). Referring to FIGS. 7–10, three main components form the structure of the upper portion 160 of the liquid discharge assembly 162: a valve housing 164, the three position ball valve 58 and a discharge elbow 166. As seen in FIG. 7, the elbow 166 seats in an elbow cavity 168 formed in the housing 164, and the elbow 166 is connected to the housing 164 by any means practical—a pair of screws 170 (FIG. 8) in this embodiment. A pair of connection tabs 171 (FIG. 8) and a series of positioning ribs 172 are formed integral with the elbow 166. When the vacuum cleaner 30 is assembled, the connection tabs 171 are used to connect the upper portion 160 of the liquid discharge assembly 162 to the motor housing 46, and the positioning ribs 172 are used to align the elbow 166 in the motor housing 46. The elbow 166 also has a pair of J-shaped grooves 173 formed therein for connecting a lower portion 218 of the liquid discharge assembly 162 to the upper portion 160 (FIG. 10). A plug 175 may be placed in the elbow 166 during dry vacuuming to plug an opening 177 in the elbow 166 (FIG. 3). The plug 175 interacts with the J-shaped grooves 173 in the elbow 166 to keep the plug 175 in place.

The elbow 166 forms a liquid-tight seal with the housing 164 by means of series of seals and closures. In this embodiment, O-rings are used as seals, but it is envisioned that any form of seal known in the art would suffice. A housing closure 174, formed integral with the elbow 166, caps off the housing 164 at the point where the housing 164 meets the elbow 166. Internal to the housing 164, a seal 176 disposed around the elbow 166 creates a liquid-tight seal between the housing 164 and the elbow 166, and a seal 178 disposed between the elbow 166 and the ball valve 58 prevents liquid from leaking between the two.

The ball valve 58 has a positional knob 180 formed integral with a flow regulation ball 182. The ball 182 has a passageway 184 bored therethrough, and the ball 182 is capable of being turned such that the passageway 184 is placed in fluid communication with the interior of the elbow 166. The positional knob 180 is situated outside the housing 164. As discussed above, a seal 178 keeps liquid from leaking between the ball 182 and the elbow 166. A similar seal 186 disposed on the opposite side of the ball 182 keeps liquid from leaking between the ball 182 and the housing 164. Another seal 188, disposed between the ball 182 and the knob 180, prevents liquid from leaking past the knob 180. The vacuum cleaner discharge opening 56 is defined by the housing 164 and is encircled by a threaded portion so that a user may connect a discharge hose 190 (FIG. 10) having a threaded connector 192 (e.g. a garden hose) to the housing 164 when discharging liquid, if desired. The housing 164 also includes an air passage check valve 200. The air passage check valve 200 is formed beneath the flow regulation ball 182 and may be placed in air flow communication with the interior of the discharge elbow 166 when the flow regulation ball 182 is placed in the appropriate position. The air passage check valve 200 includes an air passage inlet 202, defined by the housing 164. A retaining ring 204 seats in the air passage inlet 202 and is fixed therein (a washer in this embodiment), and a check ball 206 seats in the retaining ring 204.

Referring specifically to FIGS. 7, 8 and 9A–C, the ball valve 58 has three operational positions to control the priming of the pump 128 and to control the flow rate of the liquid being discharged. FIG. 9A shows the ball valve 58 in the closed (OFF) position, when the pump is not primed and is not discharging any liquid; FIG. 9B shows the ball valve 58 in the priming position, when the pump is being primed for discharging liquid; and FIG. 9C shows the ball valve 58 in the full open (ON) position, where the pump is primed and discharging liquid at the maximum allowable rate. The knob 180 indicates which position the ball valve 58 is in by the location of one of three dogs 208*a–c* formed integrally with the knob 180. When the dog 208*a* is pointed towards the vacuum cleaner discharge opening 56, as in FIG. 9A, the ball valve 58 is in the closed (OFF) position. In the closed (OFF) position, the flowpath between the interior of the elbow 166 and the vacuum cleaner discharge opening 56 is interrupted by the flow regulation ball 182. In this position, the flow regulation ball 182 is turned such that the passageway 184 runs perpendicular to, and out of fluid communication with, the interior of the elbow 166 and the vacuum cleaner discharge opening 56. Air flow communication between the air passage inlet 202 and the interior of the elbow 166 is also interrupted when the ball valve 58 is in the closed (OFF) position. When the dog 208*b* is pointed towards the vacuum cleaner discharge opening 56, as in FIG. 9B, the ball valve 58 is in the priming position. In the priming position, the passageway 184 is at a 45° angle to the interior of the elbow 166. In the priming position, an air flow path, as seen in FIG. 7, is created between the air passage inlet 202 and the interior of the elbow 166. As will be explained in detail below, when the vacuum cleaner 30 is operating, a vacuum is generated in the tank 32 which creates a low pressure area in the elbow 166. When the ball valve 58 is turned to the priming position, atmospheric pressure air from outside the tank 32 flows into the air passage inlet 202, past the air passage check ball 206, past the flow regulation ball 182 and into the interior of the elbow 166 to ultimately prime the pump 128. Finally, after the pump 128 has been primed and is pumping liquid from the tank 32, the user can turn the knob 180 so that the dog 208*c* is pointed towards the vacuum cleaner discharge opening 56, as in FIG. 9C. The ball valve 58 is then in the full open (ON) position with the passageway 184 aligned with the interior of the elbow 166 and the vacuum cleaner discharge opening 56 creating a complete flow path from the interior of the elbow 166 to the vacuum cleaner discharge opening 56, which allows liquid to be discharged at the maximum allowable rate.

Figure 12:
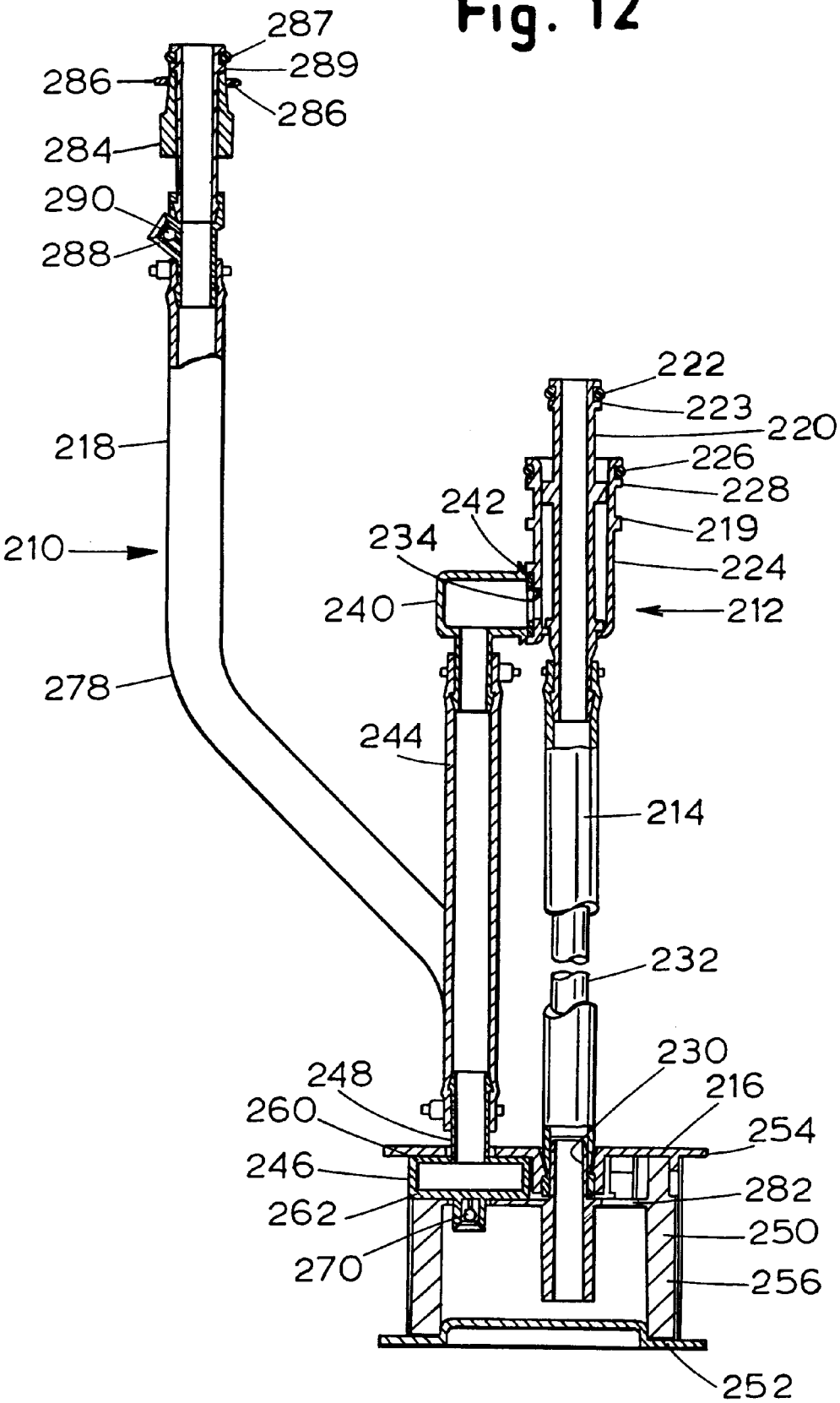
FIG. 12 is a side elevational view, partially in section, of a pump adapter assembly of the present invention.
Figure 13:
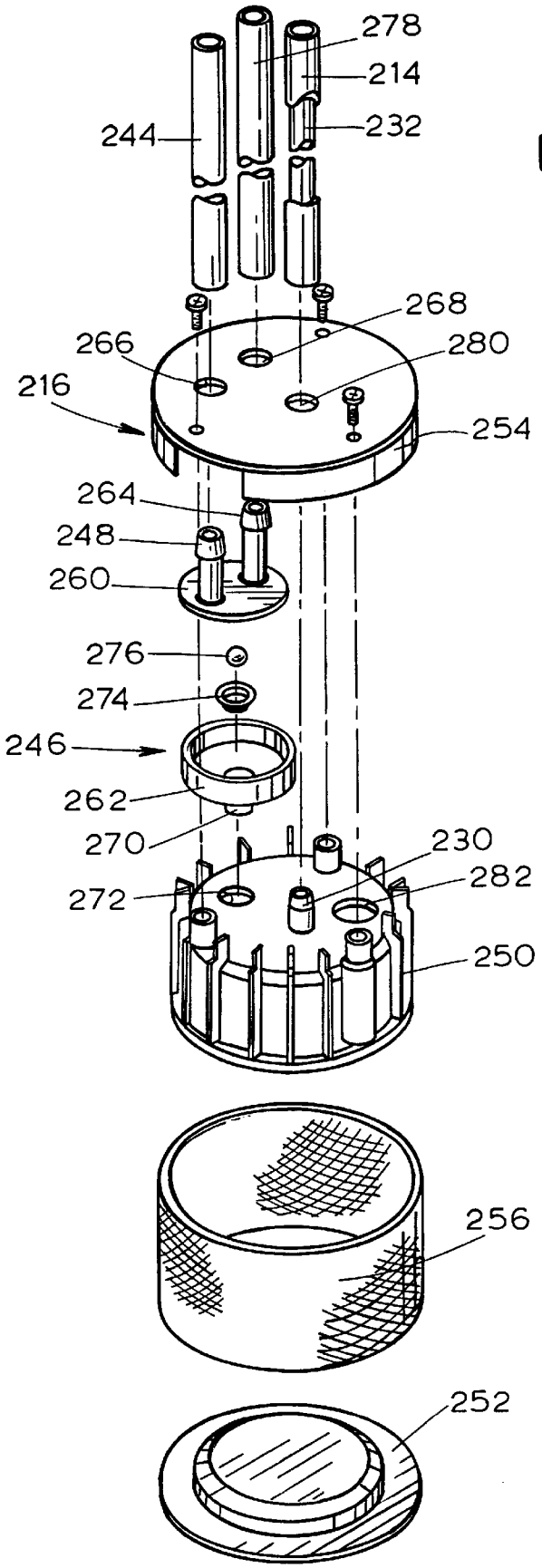
FIG. 13 is a exploded view of a liquid intake assembly of the pump adapter assembly of FIG. 12.
Figure 14:
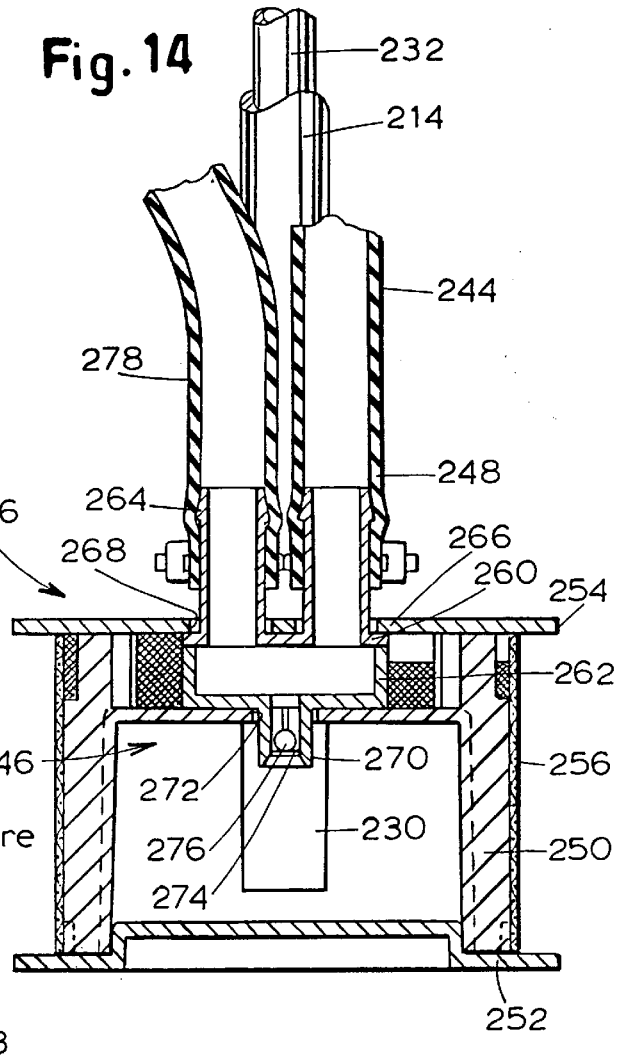
FIG. 14 is an enlarged sectional view of the liquid intake assembly of FIG. 12.

FIGS. 10–11 illustrate the vacuum cleaner 30 with a pump adapter assembly 210 installed. FIG. 12 illustrates the pump adapter assembly 210 by itself, and FIGS. 13–14 depict elements of the pump adapter assembly 210 in more detail. Referring to FIG. 10, the pump adapter assembly 210 includes a lower pump assembly 212, an inlet tube 214, a liquid intake assembly 216 and the lower portion 218 of the liquid discharge assembly 162. Referring to FIG. 11, the lower pump assembly 212, which is preferably made from ABS, extends up into the upper pump assembly 120 to complete the pump 128. The outward flare of the bottom portion of the upper outlet sidewall 136 facilitates insertion of the lower pump assembly 212 into the upper pump assembly 120. The pump adapter assembly 210 is secured in place by an oblong flange 219, which is formed integrally with a lower outlet sidewall 224 of the pump adapter assembly 210. When the pump adapter assembly 210 is in this secured disposition, the oblong flange 219 is disposed within the lid cage 106 across the oblong opening 112 of the bottom plate 110 such that the major axis of the oblong flange 219 lies substantially perpendicular to the major axis of the oblong opening 112. In this installed configuration, a pump inlet tube 220 of the lower pump assembly 212 extends up into the inlet sidewall 134 to complete the formation of the pump inlet 138, and the lower outlet sidewall 224 of the lower pump assembly 212 extends up into the upper outlet sidewall 136 to complete the formation of the pump outlet 130. The pump inlet tube 220 and the inlet sidewall 134 interact to form a liquid seal between the two. The liquid seal is formed by the interaction of a seal 222 with the inlet sidewall 134. The seal 222 is disposed in a groove 223 formed in the pump inlet tube 220. In a similar manner, the upper and lower outlet sidewalls 136, 224 also interact with each other to form a liquid seal. A seal 226 seated in a groove 228 formed in the lower outlet sidewall 224 interacts with the upper outlet sidewall 136 to form this liquid seal.

Referring again to FIG. 10, the pump inlet tube 220 fits into the inlet tube 214. The other end of the inlet tube 214 connects to a fitting 230 formed on the liquid intake assembly 216. Disposed within the inlet tube 214 is a stiffening tube 232 which acts to restrict the movement of the liquid intake assembly 216 when liquid is present in the tank 32. On the outlet side of the pump 128, a fitting 240 of the liquid discharge assembly 162 connects the liquid discharge assembly 162 to the lower outlet sidewall 224 of the pump 128. This connection places the liquid discharge assembly 162 in fluid communication with the pump outlet 130 via a pump outlet opening 234 formed in the lower outlet sidewall 224. In this embodiment, the pump outlet opening 234 is used for both priming the pump 128 and handling liquid discharge from the pump 128. However, it is foreseen that these two functions could be handled instead by two separate openings formed in communication with the pump outlet 130. A seal 242 seals the connection between the fitting 240 and the lower outlet sidewall 224. The other end of the fitting 240 fits into a first discharge tube 244. The first discharge tube 244 extends downward and connects with a priming mechanism 246, by way of a fitting 248. The priming mechanism 246 is disposed in the liquid intake assembly 216 in this embodiment. However, it is not necessary that the priming mechanism 246 be disposed in the liquid intake assembly 216. The priming mechanism 246 could be placed anywhere in the tank 32.

Referring now to FIGS. 13 and 14, the liquid intake assembly 216 is shown in greater detail. The liquid intake assembly 216 has a hollow body 250 closed on the bottom by a plate 252. A cover plate 254 is connected to the top of the hollow body 250 (in this embodiment by a set of screws), and a screen 256 is disposed around the hollow body 250 between the bottom plate 252 and the cover plate 254. The priming mechanism 246 is disposed between the cover plate 254 and the top of the hollow body 250. The priming mechanism 246 has a fitting portion 260 which seats in a liquid receptacle 262. The fitting portion 260 has two fittings formed therein: the fitting 248 and a separate fitting 264. The two fittings 248, 264 extend up through two openings 266, 268 formed in the cover plate 254. As discussed above, the fitting 248 connects with the first discharge tube 244. The fitting 264 connects with a second discharge tube 278, which is discussed in detail below. The liquid receptacle 262 of the priming mechanism 246 forms an inlet portion 270 which extends downward through an opening 272 formed in the top of the hollow body 250. A retaining ring 274 and a check valve ball 276 are disposed within the inlet portion 270 of the liquid receptacle 262. The top of the hollow body 250 also forms the fitting 230 which extends upward through an opening 280 formed in the cover plate 254 and, as discussed above, connects with the inlet tube 214. Also formed in the top of the hollow body 250 is a liquid inlet opening 282 which provides fluid communication between the interior of the hollow body 250 and the tank 32.

Referring again to FIG. 10, the second discharge tube 278 completes the flow path of the liquid discharge assembly 162. As discussed above, the second discharge tube 278 connects to the priming mechanism 246 through the fitting 264 (FIG. 14). From the priming mechanism 246, the second discharge tube 278 extends upward spanning the interior of the tank 32 and connects with the elbow 166 of the upper portion 160 of the liquid discharge assembly 162. (The plug 175 has been removed from the elbow 166.) Attached to the end of the second discharge tube 278 is a rotatable connector 284 which connects the second discharge tube 278 to the elbow 166. The rotatable connector 284 is a free spinning element and is not fixed to the second discharge tube 278. The rotatable connector 284 has a pair of bosses 286 integrally formed therewith (FIG. 12). To connect the second discharge tube 278 to the elbow 166 of the upper portion 160, the user manipulates the rotatable connector 284 to line up the bosses 286 with the pair of J-shaped grooves 173 formed in the elbow 166 (FIG.7). The user then inserts the rotatable connector 284 into the elbow 166, pushing the bosses 286 along the grooves 173 and twisting the rotatable connector 284 as necessary. When the bosses 286 reach the end of the grooves 173, the lower portion 218 of the liquid discharge assembly 162 is locked in place, and the liquid discharge assembly 162 is complete. A seal 287, disposed in a groove 289 at the end of the second discharge tube 278, prevents liquid from leaking out of the elbow 166 into the tank 32. A check valve 288, having a check valve ball 290, is disposed in the second discharge tube 278 near the rotatable connector 284.

The vacuum cleaner 30 may be operated in three modes: dry vacuuming mode, wet vacuuming mode and pumping mode. FIG. 3 shows the vacuum cleaner 30 in dry vacuuming mode configuration. In dry vacuuming mode configuration, the ball valve 58 is in the closed (OFF) position, the plug 175 is in the elbow opening 177, and the cloth filter 118 is in place around the lid cage 106 to keep dust from entering the opening 112. To convert the vacuum cleaner 30 to wet vacuuming mode configuration, the cloth filter 118 is removed. To operate the vacuum cleaner 30 in either dry or wet vacuuming mode, the user engages the actuator 62 and turns the motor 93 on. The operating motor 93 turns the air impeller 74, via the motor shaft 76, in the air impeller housing 70 which creates a vacuum in the tank 32. The user is now able to vacuum materials into the tank 32. When the user is finished vacuuming or the tank 32 is full, the user can stop vacuuming by engaging the actuator 62 to turn the motor 93 off.

To convert the vacuum cleaner 30 to pumping mode, the pump adapter assembly 210 is installed (FIGS. 10–12). To install the pump adapter assembly 210 and complete the pump 128, the user inserts the lower pump assembly 212 through the opening 112 in the lid cage bottom plate 110, aligns the oblong flange 219 with the oblong opening 112 and pushes the oblong flange 219 through the oblong opening 112 so that the oblong flange 219 is now within the lid cage 106. The user inserts the lower pump assembly 212 into the lower impeller housing 126 of the upper pump assembly 120 and, once in, twists the pump adapter assembly 210 so that the major axis of the oblong flange 219 lies substantially perpendicular to the major axis of the oblong opening 112 to secure the pump adapter assembly 210 in place. As explained above, the outward flare of the bottom portion of the upper outlet sidewall 136 facilitates insertion of the pump adapter assembly 210 into the lower impeller housing 126. During insertion, the pump inlet tube 220 slides within the upper inlet sidewall 134 of the lower impeller housing 126, and the seal 222 forms a seal with the upper inlet sidewall 134. Similarly, the lower outlet sidewall 224 of the lower pump assembly 212 slides within the upper outlet sidewall 136 of the lower impeller housing 126, and the seal 226 forms a seal with the upper outlet sidewall 136. The completed pump 128 includes the pump inlet 138, formed by the interaction of the pump inlet tube 220 and the inlet sidewall 134; the pump impeller 104 disposed in the pump chamber 129; and the pump outlet 130, formed by upper and lower outlet sidewalls 136, 224. The dimension of each of the parts of the pump 128 will be dependent on the desired flow rate of the pump 128. In addition, the power of the motor 93 may also affect the size and design of many of the components, including the pump impeller 104. To finish installation of the pump adapter assembly 210 and complete the formation of the liquid discharge assembly 162, the user connects the second discharge tube 278 to the upper portion 160 of the liquid discharge assembly 162. As explained above, to connect the second discharge tube 278 to the upper portion 160 of the liquid discharge assembly 162, the user rotates the rotatable connector 284 of the second discharge tube 278 to align the bosses 286 of the rotatable connector 284 with the J-shaped grooves 173 of the elbow 166. Once the bosses 286 are aligned, the user pushes the bosses 286 along the grooves 173 until the bosses 286 reach the end of the groove 173. Once the bosses 286 are at the end of the grooves 173, the rotatable connector 284 and the lower portion 218 of the liquid discharge assembly 162 are locked in place, and the installation of the pump adapter assembly 210 and the formation of the liquid discharge assembly 162 are complete.

If the user desires to filter large particulates out of the material being drawn into the vacuum cleaner 30, the user may install a mesh collection bag in the tank 32 and connect the bag to the inlet 40. The mesh collection bag may be of the type disclosed and claimed in U.S. patent application Ser. No. 08/903,635. Once the pump adapter assembly 210 is installed, and if desired any collection bags, the user inserts the combined upper vacuum assembly 34/pump adapter assembly 210 into the tank 32 and then secures the lid 44 to the tank 32 with the latches 52.

Referring to FIG. 10, to operate the vacuum cleaner 30 in combined wet vacuuming mode and pumping mode operation, the user first turns the motor 93 "ON" by engaging the actuator 62. The now energized motor 93 simultaneously turns the air impeller 74 and the pump impeller 104 via the motor shaft 76/shaft extension 78 combination. The air impeller 74, rotating in the housing 70, reduces the pressure in the tank 32, creating a vacuum. (In this embodiment, the vacuum hose 43 must be disposed in the inlet 40 to create the necessary vacuum in the tank 32 for the vacuum cleaner 30 to operate properly. However, the vacuum cleaner 30 of the present invention could be designed to operate properly without the vacuum hose 43 being required to be in the inlet 40 (e.g., a smaller diameter inlet, a larger air impeller, etc.)) The vacuum created in the tank 32 draws air, liquid and/or other material into the tank 32 through the vacuum hose 43 and the inlet 40. If a mesh collection bag is in place around the inlet 40, the mesh collection bag will filter out the exceptionally large particulates being vacuumed into the tank 32 and will reduce the possibility of the pump 128 getting clogged. Even if the pump 128 is not being used, the mesh collection bag could still be used to filter large particulates out from the liquid being collected in the tank 32 so that when the tank 32 is poured or emptied into a drain, the large particulates will not clog the drain. The air that is drawn into the tank 32 passes through the foam filter 116, through the lid cage 106, into the motor housing 46, and finally is expelled out of the discharge slots 54.

Figure 15:
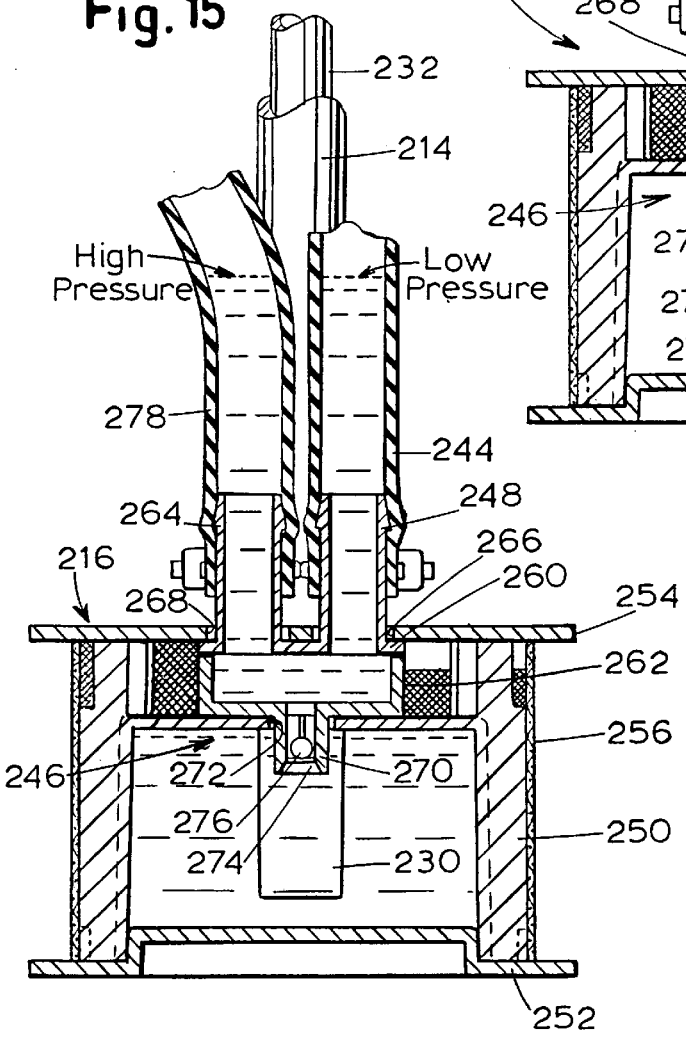
FIG. 15 is a sectional view similar to FIG. 14 showing the liquid intake assembly filled with liquid.

As the motor 93 continues to operate, liquid will continue to collect in the tank 32. When the user is ready to start pumping the liquid out of the tank 32, the pump 128 must be primed. The pump 128 will either selfprime or will need to be primed by the user. Priming of the pump 128 occurs in the following manner. As liquid collects in the tank 32 and the liquid level rises, liquid will enter into the liquid intake assembly 216. The liquid will flow through the screen 256 and into the hollow body 250 through the opening 282. Liquid will then collect in the hollow body 250. When the liquid level in the hollow body 250 reaches the inlet portion 270 of the liquid receptacle 262, the liquid will push past the check valve ball 276 and will begin to collect in the liquid receptacle 262. The liquid level in the liquid receptacle 262 will continue to rise and will begin to fill the fittings 248, 264 and the corresponding first and second discharge tubes 244, 278 (FIG. 15). Once the liquid volume collected in the first and second discharge tubes 244, 278 is equal to the liquid volume needed to fill the space between the pump impeller 104 and the liquid intake assembly 216, the pump 128 is in a condition to be primed. If the knob 180 is in the full open (ON) position or the priming position, the pump 128 will self-prime because the liquid collected in the second discharge tube 278 will be exposed to relatively high pressure, atmospheric pressure air. (However, it is possible that the pump 128 will not self-prime when the knob 180 is in the full open (ON) position if some form of blockage (e.g., liquid trapped in the discharge hose 190 connected to the vacuum cleaner discharge opening 56) is preventing atmospheric pressure air from flowing into the second discharge tube 278.) The more common situation, however, will be for the knob 180 to be in the closed (OFF) position because the user will not want the pump 128 to start pumping until the user is ready. In the closed (OFF) position, the pump 128 will not self-prime.

Referring to FIG. 15, priming of the pump 128 is caused by a sufficient amount of liquid being collected in the first and second discharge tubes 244, 278 and a high pressure/low pressure differential being established across this collected liquid. In the usual circumstance, with the knob 180 in the closed (OFF) position, it would be difficult to collect a sufficient amount of liquid in the priming mechanism 246 to prime the pump 128 if the check valve 288 (FIG. 10) were not present. Without the check valve 288, the second discharge tube 278 would become pressurized, and the high pressure system created in the second discharge tube 278 would prevent liquid from entering the second discharge tube 278. Without liquid in the second discharge tube 278, there would be inadequate liquid collected in the priming mechanism 246 to purge the space between the pump impeller 104 and the liquid intake assembly 216. With the check valve 288, however, the second discharge tube 278 does not become pressurized when the knob 180 is in the closed (OFF) position because the check valve 288 allows pressurized air to be released from the second discharge tube 278 and keeps the second discharge tube 278 at the same pressure as the interior of the tank 32. This allows liquid to collect in the second discharge tube 278. Once a sufficient amount of liquid is collected, the ball valve 58 can be turned from the closed (OFF) position to the priming position, and the pump 128 will prime because a low pressure system, caused by the first discharge tube 244 being in air flow communication with the interior of the tank 32, and a high pressure system, caused by the second discharge tube 278 being in air flow communication with atmospheric pressure air via the air passage inlet 202, act in concert to establish a pressure differential across the liquid in the liquid receptacle 262. This pressure differential acts to push the liquid collected in the first and second discharge tubes 244, 278 up the remainder of the first discharge tube 244, through the pump outlet 130, into the pump chamber 129 and down through the pump inlet 138 and the inlet tube 214, thereby purging the pump 128 of air and priming the pump 128 (FIG. 10).

The primed pump 128 will then pump the collected liquid out of the tank 32. Referring to FIG. 10, the liquid collected in the tank 32 will flow from the tank 32 through the screen 256, into the hollow body 250, up the inlet tube 214 and the pump inlet 138, and into the pump chamber 129. At this point, some of this liquid will splash through the gap 140, but the majority of this liquid will be pumped downward into the pump outlet 130, where the liquid will flow through the pump outlet opening 234 into the liquid discharge assembly 162 and out of the vacuum cleaner 30 through the vacuum cleaner discharge opening 56. Once primed, the user can turn the knob 180 so that the dog 208*c* is pointed towards the vacuum cleaner discharge opening 56, putting the passageway 184 in alignment with the interior of the elbow 166 and the vacuum cleaner discharge opening 56 (FIG. 9C). This will permit the pumped liquid to be discharged at a maximum flow rate. Once the pump 128 is primed, it is not likely to lose its prime due to deterioration of the seal 222. When the pump 128 is pumping liquid out, the seal 222 is surrounded by liquid because both the area enclosed by the inlet sidewall 134 and the pump outlet 130 are filled with liquid. As such, even if the seal 222 begins to deteriorate, air will not enter the pumping chamber 129 and cause the pump 128 to lose its prime. The pump 128 will, however, operate less efficiently in this situation.

If, while vacuuming, the level of the liquid in the tank 32 gets too high, the mechanical shut-off and override assembly 150 will automatically shut-off the motor 93. When the liquid in the tank 32 gets to the level of the float 154, the liquid pushes the float 154 upward which pushes the float rod 152 upward. Eventually, the rising liquid will push the float rod 152 high enough to turn the switch 151 "OFF" which stops the motor 93 and stops the air impeller 74 and the pump impeller 104 from rotating. The float 154 should be placed at a height low enough so that the motor 93 is turned "OFF" before the level of liquid is high enough to begin entering the air impeller 74. Once the motor 93 has been turned "OFF", the user has two options: the user may either remove the upper vacuum assembly 34 and manually empty the tank 32 or the user may bypass the float shut-off by mechanically overriding the float shut-off. When the user is finished either vacuuming or pumping with the vacuum cleaner 30, the user turns the vacuum cleaner 30 "OFF" by pushing downward on the user engageable actuator 62.

Figure 16:
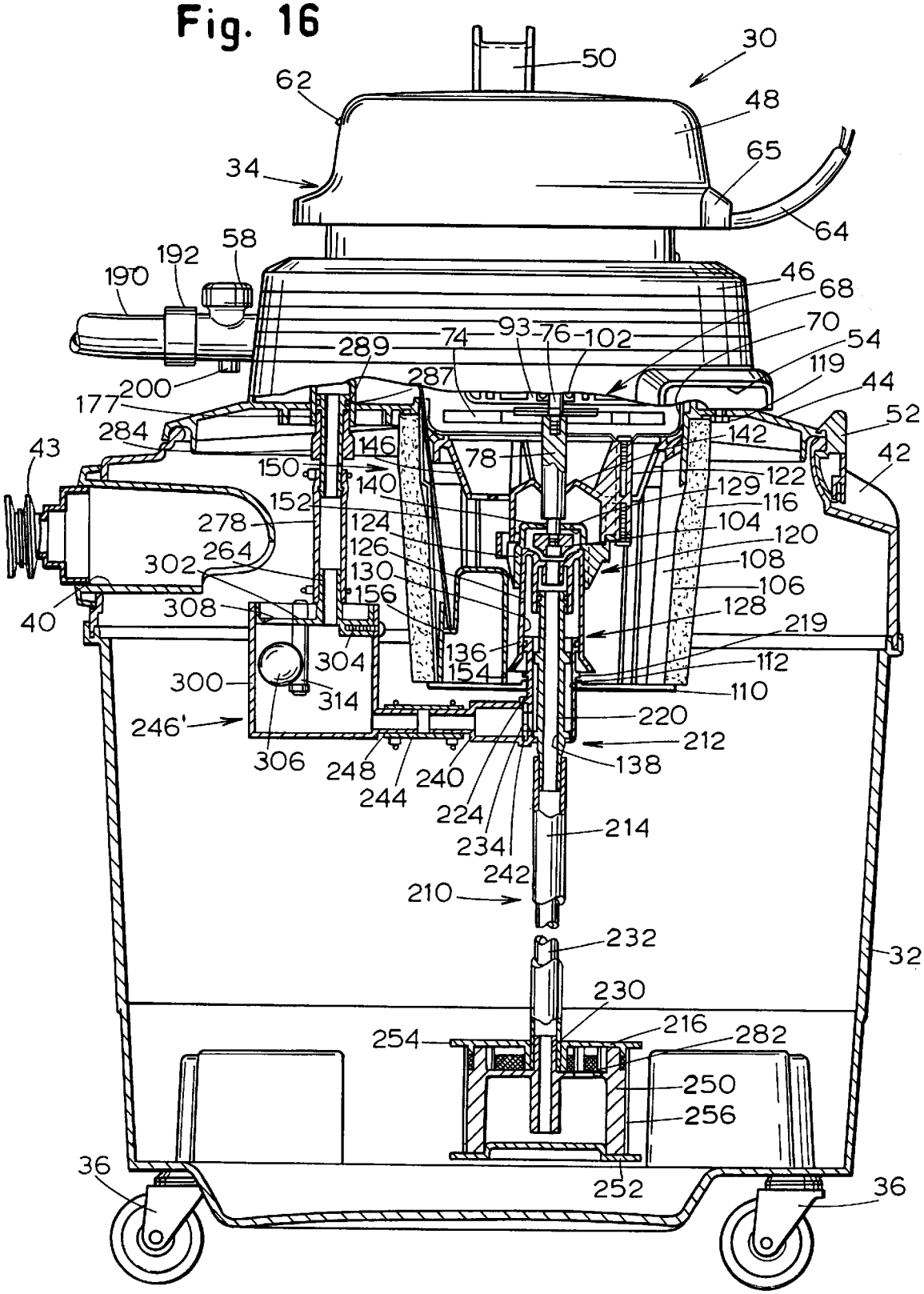
FIG. 16 is a view similar to FIG. 10 showing a second embodiment of the vacuum cleaner of the present invention.

Referring to FIGS. 16–18, an alternative embodiment of the present invention is illustrated. The vacuum cleaner 30 and the pump 128 of this embodiment operate as previously described and, as such, similar parts are numbered similarly. This embodiment incorporates an alternative priming mechanism 246'. As with the priming mechanism 246, the alternative priming mechanism 246' is included in the pump adapter assembly 210 and is disposed between the first and second discharge tubes 244, 278. Similar to the connections in the other embodiment, the fitting 248 connects the alternative priming mechanism 246' to the first discharge tube 244 and the fitting 264 connects the alternative priming mechanism 246' to the second discharge tube 278. Referring specifically to FIGS. 17A and 17B, the alternative priming mechanism 246' includes a liquid collection cup 300, a cup cover 302 disposed within the top of the collection cup 300 and a ball 306 disposed within the collection cup 300. The fitting 248 is formed integral with the collection cup 300, and the fitting 264 is formed integral with the cup cover 302. A screw 304 attaches the cup cover 302 to the collection cup 300. The cup cover 302 has an opening 308 formed therein, and a screen 310 is disposed across, and fixed to, the top of the cup cover 302. The fitting 264 of the cup cover 302 passes through an opening 312 formed in the screen 310. A ball guidepost 314 is fixed in place and extends downward into the collection cup 300. The ball guidepost 314 acts in concert with the wall of the collection cup 300 to restrict the path of the ball 306 so that the ball 306 always engages the opening 308 in the cup cover 302 when the collection cup 300 is filled with sufficient liquid (FIG. 17B). The alternative priming mechanism 246' is disposed within the tank 32 at a height such that liquid entering the inlet 40 will fill the collection cup 300 as well as the tank 32.

The alternative priming mechanism 246' operates on the same principle to prime the pump 128 as the previously described embodiment. A high pressure/low pressure differential is established across the liquid collected in the collection cup 300 to prime the pump 128. When the air impeller 74 is operating and liquid is being drawn into the tank 32, liquid will pass through the inlet 40. Most of this liquid will fall into the tank 32, but some of the liquid, due to the location of the alternative priming mechanism 246', will fall into the alternative priming mechanism 246'. The liquid falling into the alternative priming mechanism 246' passes through the screen 310, through the opening 308 in the cup cover 302 and into the collection cup 300. The initial liquid that is collected will fill the first discharge tube 244 and the fitting 248 and will begin to fill the pump outlet 130. As more liquid is collected, then the liquid level in the collection cup 300 will rise. As the liquid level in the collection cup 300 rises, the liquid will push the ball 306 upward along the ball guidepost 314. Eventually, the liquid level in the collection cup 300 will rise high enough that the ball 306 will seat in the opening 308 of the cup cover 302 (FIG. 18). The pump 128 is now in a condition to be primed by the alternative priming mechanism 246'. When the user turns the knob 180 to the priming position or the full open (ON) position, relatively high pressure, atmospheric pressure air will fill the second discharge tube 278 and the portion of the collection cup 300 between the top of the collected liquid and the cup cover 302. At the same time, the collected liquid in the pump outlet 130 is being exposed to a low pressure system since the pump outlet 130 is in air flow communication with the interior of the tank 32 via the gap 140. This high/low pressure system acts on the liquid collected in the collection cup 300 to establish a pressure differential across the liquid in the collection cup 300. Similar to the other embodiment, this pressure differential acts to push the liquid collected in the collection cup 300, through the first discharge tube 244, through the pump outlet 130, into the pump chamber 129 and down through the pump inlet 138 and the inlet tube 214, thereby purging the pump 128 of air and priming the pump 128. The primed pump 128 will then pump the collected liquid out of the tank 32 as described above. It is foreseen that the alternative priming mechanism 246' would be capable of priming the pump 128 even without the gap 140 between the upper impeller housing 124 and the shaft extension 78 to provide air flow communication between the pump outlet 130 and the interior of the tank 32. If the inlet 40 was disposed higher than the collection cup 300 in the vacuum cleaner 30 and the collection cup 300 was disposed higher than the pump chamber 129, then the pump 128 could be primed by liquid coming in through the inlet 40, falling into collection cup 300 and flowing downward to the pump chamber 129.

The effectiveness of the high pressure area created between the top of the collected liquid in the collection cup 300 and the cup cover 302 will not be diluted by the low pressure area present in the tank 32 because the ball 306, which is seated in the opening 308, acts to prevent the high pressure area created in the collection cup 300 from interacting with the low pressure area present in the tank 32. Also, in this embodiment, a check valve 288 is not necessary. Due to the location of the alternative priming mechanism 246' and the size of the collection cup 300, enough liquid can be collected in the collection cup 300 to fill the space between the collection cup 300 and the pump chamber 129 when priming without the use of the second discharge tube 278.

The vacuum cleaner of the present invention has significant advantages over prior vacuum cleaners. By providing a pump to remove liquid from the tank, liquid can be emptied easily into drains at a variety of heights. Driving the pump impeller off of the same motor which drives the air impeller significantly reduces the cost of the vacuum cleaner over designs which require a separate motor for the pump. By locating the pump in the tank directly below the air impeller, the pump impeller can be simply and efficiently driven off a single axle connected to the air impeller. Removability of the pump adapter assembly provides significant efficiency when the vacuum cleaner is used on dry material. Also, the priming assembly of the present invention provides a simple, easy to use, and cost effective priming system.

The foregoing detailed description has been given for clearness of understanding only, and no unnecessary limitations should be understood therefrom, as modifications would be obvious to those skilled in the art.

What is claimed is:

1. A vacuum cleaner comprising:

a tank having an inlet for receiving liquid material and an interior;

a powered pump defining an interior and a pump outlet and further defining an aperture, the pump outlet defines a priming opening and the aperture places the interior of the pump and the priming opening in air flow communication with the interior of the tank;

an air impeller assembly disposed in air flow communication with the interior of the tank, the air impeller includes a housing defining an opening and a driven impeller disposed within the housing, the housing opening places the driven impeller in air flow communication with the interior of the tank, wherein the driven impeller creates a relatively low pressure area in the interior of the tank, the pump interior and the priming opening of the pump outlet; and a priming mechanism disposed within the tank for collecting and retaining liquid received by the tank, the priming mechanism is in air flow communication with a source of pressure which is high relative to the relatively low pressure created in the interior of the tank by the driven impeller, the priming mechanism is in fluid communication with the priming opening of the pump outlet, wherein when a sufficient amount of liquid material is collected in the priming mechanism, the source of relatively high pressure acts in concert with the relatively low pressure in the priming opening to establish a pressure differential across the liquid collected in the priming mechanism, wherein the pump is primed.

2. The vacuum cleaner of claim 1, wherein the pump outlet further defines a discharge opening, and the vacuum cleaner further comprises:

a liquid discharge assembly defining a vacuum cleaner discharge opening, the liquid discharge assembly is in fluid communication with the discharge opening of the pump outlet for discharging the liquid received by the tank from the vacuum cleaner through the vacuum cleaner discharge opening.

3. The vacuum cleaner of claim 2, wherein the priming opening of the pump outlet and the discharge opening of the pump outlet are the same opening; and the priming mechanism is disposed within the liquid discharge assembly.

4. The vacuum cleaner of claim 3 comprising:

a valve disposed in the liquid discharge assembly between the priming mechanism and the vacuum cleaner discharge opening, wherein the valve regulates priming of the pump and the discharge of the liquid received by the tank from the vacuum cleaner.

5. The vacuum cleaner of claim 4, wherein the valve includes an air inlet passage, and the valve is movable between at least two positions:

a first position in which the valve blocks air flow communication between the air inlet passage and the priming mechanism; and a second position in which the valve permits air flow communication between the air inlet passage and the priming mechanism.

6. The vacuum cleaner of claim 3, wherein the powered pump includes an upper pump assembly and a lower pump assembly, the liquid discharge assembly includes an upper portion and a lower portion and the vacuum cleaner further comprises:

a pump adapter assembly which includes the lower pump assembly, the lower portion of the liquid discharge assembly and the priming mechanism, wherein the pump adapter assembly is removable from the vacuum cleaner and the pump adapter assembly separates from the vacuum cleaner along the connection between the upper and lower pump assemblies and along the connection between upper and lower portions of the liquid discharge assembly.

7. The vacuum cleaner of claim 6, wherein the pump adapter assembly includes a liquid intake assembly; and the priming mechanism is disposed in the liquid intake assembly.

8. The vacuum cleaner of claim 1, wherein the source of relatively high pressure is atmospheric pressure air.

9. The vacuum cleaner of claim 1 comprising a vacuum hose disposed in the tank inlet.

10. The vacuum cleaner of claim 1 comprising:

a first tube disposed between the priming mechanism and the priming opening of the pump outlet, the first tube putting the priming mechanism in fluid communication with the priming opening of the pump outlet;

a second tube disposed between the priming mechanism and the source of relatively high pressure, the second tube putting the priming mechanism in fluid flow communication with the source of relatively high pressure; and the priming mechanism includes a liquid receptacle and a check valve disposed within the liquid receptacle for retaining liquid collected by the liquid receptacle, wherein the liquid receptacle collects and retains liquid received by the tank and when a sufficient amount of liquid material is collected in the liquid receptacle and the first and second tubes, thereby priming the pump.

11. The vacuum cleaner of claim 1 comprising:

a first tube disposed between the priming mechanism and the priming opening of the pump outlet, the first tube putting the priming mechanism in fluid communication with the priming opening of the pump outlet;

a second tube disposed between the priming mechanism and the source of relatively high pressure, the second tube putting the priming mechanism in fluid flow communication with the source of relatively high pressure; and the priming mechanism includes a collection cup, a collection cup cover defining an opening and a ball, the collection cup cover is disposed across the top of the collection cup cover, wherein the collection cup collects and retains liquid received by the tank and when a sufficient amount of liquid material is collected, the ball seats in the opening of the collection cup cover, thereby priming the pump.

12. A vacuum cleaner comprising:

a tank having an inlet for receiving liquid material and an interior;

a powered pump defining an interior and a pump outlet and further defining an aperture, the pump outlet defines a priming opening and the aperture places the interior of the pump and the priming opening in air flow communication with the interior of the tank;

an air impeller assembly disposed in air flow communication with the interior of the tank, the air impeller includes a housing defining an opening and a driven impeller disposed within the housing, the housing opening places the driven impeller in air flow communication with the interior of the tank, wherein the driven impeller creates a relatively low pressure area in the interior of the tank, the pump interior and the priming opening of the pump outlet;

a priming mechanism disposed within the tank for collecting and retaining liquid received by the tank, a source of atmospheric pressure air;

a first tube disposed between the priming mechanism and the priming opening of the pump outlet, the first tube putting the priming mechanism in fluid communication with the priming opening of the pump outlet; and a second tube disposed between the priming mechanism and the source of atmospheric pressure air, the second tube putting the priming mechanism in fluid flow communication with the source of atmospheric pressure air;

wherein when a sufficient amount of liquid material is collected in the priming mechanism and the first and second tubes, the source of atmospheric pressure air acts in concert with the relatively low pressure in the priming opening to establish a pressure differential across the liquid collected in the priming mechanism and the first and second tubes, wherein the pump is primed.

13. The vacuum cleaner of claim 12, wherein the pump outlet further defines a discharge opening, and the vacuum cleaner further comprises:

a liquid discharge assembly defining a vacuum cleaner discharge opening, the liquid discharge assembly includes the first and second tubes and the first and second tubes are in fluid communication with the discharge opening of the pump outlet for discharging the liquid received by the tank from the vacuum cleaner through the vacuum cleaner discharge opening.

14. The vacuum cleaner of claim 13, wherein the priming opening of the pump outlet and the discharge opening of the pump outlet are the same opening; and the priming mechanism is disposed within the liquid discharge assembly between the first and second tubes.

15. The vacuum cleaner of claim 14 comprising:

a valve disposed in the liquid discharge assembly between the priming mechanism and the vacuum cleaner discharge opening, wherein the valve regulates priming of the pump and the discharge of the liquid received by the tank from the vacuum cleaner.

16. The vacuum cleaner of claim 15, wherein the valve includes an air inlet passage, and the valve is movable between at least two positions:

a first position in which the valve blocks air flow communication between the air inlet passage and the priming mechanism; and a second position in which the valve permits air flow communication between the air inlet passage and the priming mechanism.

17. The vacuum cleaner of claim 14, wherein the powered pump includes an upper pump assembly and a lower pump assembly, the liquid discharge assembly includes an upper portion and a lower portion and the vacuum cleaner further comprises:

a pump adapter assembly which includes the lower pump assembly, the lower portion of the liquid discharge assembly and the priming mechanism, wherein the pump adapter assembly is removable from the vacuum cleaner and the pump adapter assembly separates from the vacuum cleaner along the connection between the upper and lower pump assemblies and along the connection between upper and lower portions of the liquid discharge assembly.

18. The vacuum cleaner of claim 17, wherein the pump adapter assembly includes a liquid intake assembly; and the priming mechanism is disposed in the liquid intake assembly.

19. The vacuum cleaner of claim 12, wherein the priming mechanism includes a liquid receptacle and a check valve disposed within the liquid receptacle for retaining liquid collected by the liquid receptacle, wherein the liquid receptacle collects and retains liquid received by the tank and when a sufficient amount of liquid material is collected in the liquid receptacle and the first and second tubes, thereby priming the pump.

20. The vacuum cleaner of claim 12, wherein the priming mechanism includes a collection cup, a collection cup cover defining an opening and a ball, the collection cup cover is disposed across the top of the collection cup cover, wherein the collection cup collects and retains liquid received by the tank and when a sufficient amount of liquid material is collected, the ball seats in the opening of the collection cup cover, thereby priming the pump.

21. A vacuum cleaner comprising:

a tank having an inlet for receiving liquid material and an interior;

a powered pump including a pump housing positioned above a lower portion of the tank defining an interior, a pump inlet, a pump outlet, and an aperture, the pump outlet defines a priming opening, and the aperture places the interior of the pump, the priming opening, and the pump inlet in fluid communication with the interior of the tank, the pump further including an inlet tube having a first end attached to the pump inlet and a second end disposed in a lower portion of the tank;

an air impeller assembly disposed in air flow communication with the interior of the tank, the air impeller includes a housing defining an opening and a driven impeller disposed within the housing, the housing opening places the driven impeller in air flow communication with the interior of the tank, wherein the driven impeller creates a relatively low pressure area in the interior of the tank, the pump interior, the pump inlet, and the priming opening; and a priming mechanism for collecting liquid received by the tank disposed lower than the tank inlet and higher than the second end of the inlet tube, the priming mechanism including a priming tube connecting the priming mechanism to the priming opening of the pump outlet, wherein liquid material collected in the priming mechanism flows through the priming tube and the priming opening in the pump outlet and into the interior of the pump, thereby priming the pump.

* * * * *